US008876337B2

(12) United States Patent
Howe

(10) Patent No.: US 8,876,337 B2
(45) Date of Patent: Nov. 4, 2014

(54) LIGHT FIXTURES AND MULTI-PLANE LIGHT MODIFYING ELEMENTS

(71) Applicant: Leslie David Howe, Atlanta, GA (US)

(72) Inventor: Leslie David Howe, Atlanta, GA (US)

(73) Assignee: Southpac Trust International, Inc., Rarotonga (CK), Trustee of the LDH Trust ( * ) Notice: Subject to any disclaimer, the term of this patent is extended or adjusted under 35 U.S.C. 154(b) by 0 days.

(21) Appl. No.: 14/254,960

(22) Filed: Apr. 17, 2014

(65) Prior Publication Data

US 2014/0233231 A1 Aug. 21, 2014

Related U.S. Application Data

(63) Continuation-in-part of application No. 13/531,515, filed on Jul. 23, 2012, and a continuation-in-part of application No. 14/225,546, filed on Mar. 26, 2014, and a continuation-in-part of application No. 14/231,819, filed on Apr. 1, 2014, and a continuation-in-part of application No. PCT/US2013/039895, filed on May 7, 2013, and a continuation-in-part of application No. PCT/US2013/059919, filed on Sep. 16, 2013.

(60) Provisional application No. 61/959,641, filed on Aug. 27, 2013, provisional application No. 61/963,037, filed on Nov. 19, 2013, provisional application No. 61/963,603, filed on Dec. 9, 2013, provisional application No. 61/963,725, filed on Dec. 13, 2013, provisional application No. 61/964,060, filed on Dec. 23, 2013, provisional application No. 61/964,422, filed on Jan. 6, 2014, provisional application No. 61/965,710, filed on Feb. 6, 2014, provisional application No. 61/958,559, filed on Jul. 30, 2013.

(51) Int. Cl.

| | |
|---|---|
| ***F21V 7/04*** | (2006.01) |
| ***F21V 7/16*** | (2006.01) |
| ***F21V 13/02*** | (2006.01) |
| ***F21K 99/00*** | (2010.01) |
| ***F21V 7/20*** | (2006.01) |
| *F21V 5/04* | (2006.01) |

(52) U.S. Cl.

CPC . *F21V 5/043* (2013.01); *F21V 7/16* (2013.01); *F21V 13/02* (2013.01); *F21K 9/175* (2013.01); *F21K 9/50* (2013.01); *F21V 7/20* (2013.01)

USPC ..... 362/332; 362/335; 362/346

(58) Field of Classification Search

USPC ..... 362/326–349, 445

See application file for complete search history.

(56) References Cited

U.S. PATENT DOCUMENTS

2011/0058353 A1* 3/2011 Yang ..... 362/84

*Primary Examiner* — Karabi Guharay
*Assistant Examiner* — Nathaniel Lee
(74) *Attorney, Agent, or Firm* — Troutman Sanders, LLP; James E. Schutz; Mark Lehi Jones

(57) ABSTRACT

In an example embodiment, a light fixture is provided that includes an enclosure with an aperture plane and two or more linear light emitting diode (LED) arrays configured to mount within the enclosure on LED array mounting features that are oriented at an angle between about 80 degrees and about 135 degrees relative to a back surface plane of the enclosure. The light fixture may further include a lens with an axis of symmetry defining two opposing lens halves that define substantially planar outer portions and curved inner portions. The two lens halves may be configured to intersect or join in proximity to the axis of symmetry that is disposed parallel, and above or in proximity to the two or more linear LED arrays. The outer edges of the substantially planar outer lens portions are disposed in proximity to opposing edges of the aperture plane of the enclosure.

26 Claims, 28 Drawing Sheets

FIG 13A
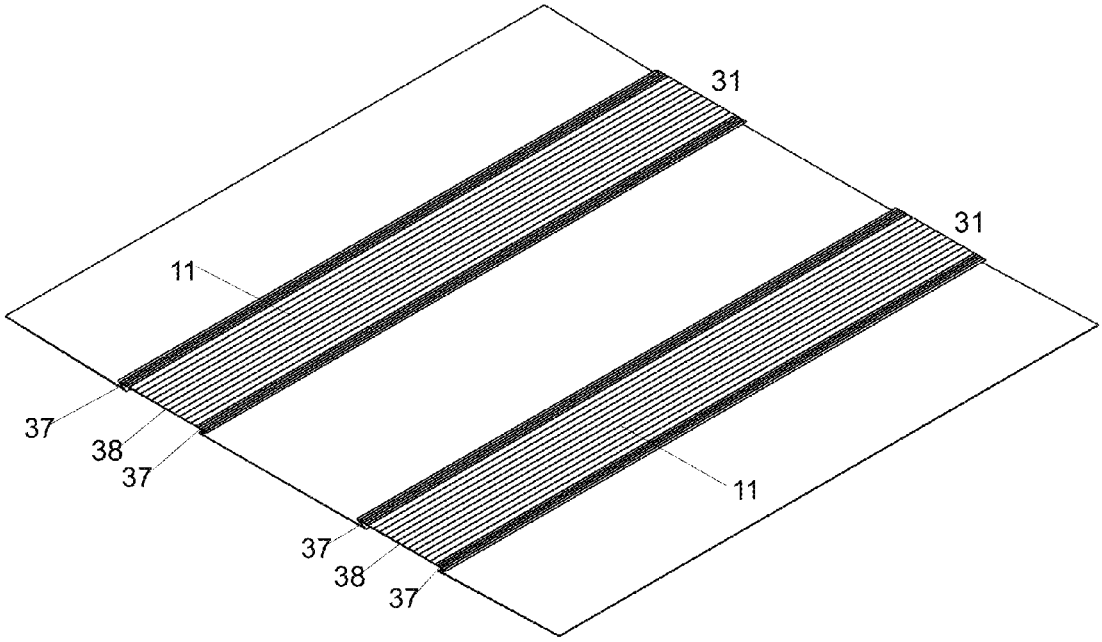
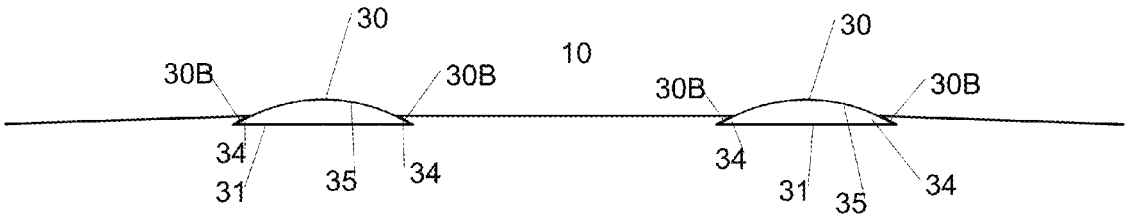
FIG 13B

LIGHT FIXTURES AND MULTI-PLANE LIGHT MODIFYING ELEMENTS

RELATED APPLICATIONS

This application is a continuation-in-part of US Patent Publication No. US20120300471 A1 entitled "Light Diffusion and Condensing Fixture," filed Jul. 23, 2012; and also a continuation-in-part of U.S. patent application Ser. No. 14/225,546, entitled "Frameless Light Modifying Element," filed Mar. 26, 2014; and also a continuation-in-part of U.S. patent application Ser. No. 14/231,819, entitled "Light Modifying Elements," filed Apr. 1, 2014, the contents of which are incorporated by reference in their entirety as if set forth in full. This application is also a continuation-in-part of PCT Application No. PCT/US2013/039895, entitled "Frameless Light Modifying Element," filed May 7, 2013; and is also a continuation-in-part of PCT Application No. PCT/US2013/059919, entitled "Light Modifying Elements," filed Sep. 16, 2013, the contents of which are also incorporated by reference in their entirety as if set forth in full.

This application also claims the benefit of the following United States Provisional Patent Applications, the contents of which are incorporated by reference in their entirety as if set forth in full: U.S. Provisional Patent Application No. 61/958,559, entitled "Hollow Truncated-Pyramid Shaped Light Modifying Element," filed Jul. 30, 2013; U.S. Provisional Patent Application No. 61/959,641 entitled "Light Modifying Elements," filed Aug. 27, 2013; U.S. Provisional Patent Application No. 61/963,037, entitled "Light Fixtures and Multi-Plane Light Modifying Elements," filed Nov. 19, 2013; U.S. Provisional Patent Application No. 61/963,603, entitled "LED Module," filed Dec. 9, 2013; U.S. Provisional Patent Application No. 61/963,725, entitled "LED Module and Inner Lens System," filed Dec. 13, 2013; U.S. Provisional Patent Application No. 61/964,060, entitled "LED Luminaire, LED Mounting Method, and Lens Overlay," filed Dec. 23, 2013; U.S. Provisional Patent Application No. 61/964,422 entitled "LED Light Emitting Device, Lens, and Lens-Partitioning Device," filed Jan. 6, 2014; and U.S. Provisional Patent Application No. 61/965,710, entitled "Compression Lenses, Compression Reflectors and LED Luminaries incorporating the same," filed Feb. 6, 2014.

TECHNICAL FIELD

This invention generally relates to lighting, light fixtures and lenses.

BACKGROUND

There is a continuing need for low cost systems that can improve the light quality of light fixture using LED light sources.

BRIEF SUMMARY

In an example embodiment, a light fixture may comprise an enclosure with four or more sides, an enclosure back surface defining a back surface plane of the enclosure, a center axis that is equidistant and parallel to two of the four or more sides, and an aperture plane defined by outermost edges of the four or more sides. Two or more linear light emitting diode (LED) arrays may be configured to mount within the enclosure, wherein each linear LED array may comprise one or more linear LED strips comprising one or more rows of LEDs. Each LED array may comprise a front light emitting side, and a backside opposite of the front light emitting side. In an example implementation, one or more LED array mounting features may be configured to dissipate heat generated from linear LED arrays, wherein each LED array mounting feature may comprising at least two front elongated planar surfaces configured for attaching to two or more linear LED arrays. In an example embodiment, the one or more LED array mounting features may be disposed parallel and in proximity to the center axis of the enclosure back surface, and each of the at least two front elongated planar surfaces of the one or more linear LED array mounting features may face two opposite sides of the enclosure, and may be oriented at an angle between about 80 degrees and about 135 degrees relative to the back surface plane of the enclosure. In an example embodiment, the light fixture may further include a lens that may comprise a clear or translucent substrate. The clear or translucent substrate may comprise any polymer, glass or optical film, and may be configured to modify light from linear LED arrays. The lens may further comprise two lens halves defining opposing, substantially planar outer portions and curved inner portions; the planar outer portions including outer edges that may be disposed in proximity to opposing edges of an aperture plane of an enclosure, and the outer edges of the two lens halves may be substantially parallel to one other. An axis of symmetry may define the two lens halves, wherein the two lens halves may be substantially similar to one another, and wherein the two lens halves may be configured to intersect or join in proximity to the axis of symmetry. The axis of symmetry may disposed above, or in proximity to one or more LED array mounting features.

In an example embodiment, a lens may comprise a clear or translucent substrate. The clear or translucent substrate may comprise any polymer, glass or optical film, and may be configured to modify light from linear LED arrays. The lens may further comprise two opposing outer lens edges that are substantially parallel to each other, wherein each outer lens edge may be disposed in proximity to opposing edges of the aperture plane of an enclosure. A V-shaped bi-planar center lens section may be disposed over one or more LED array mounting features, and may comprise a peak axis and two base axes, wherein the peak axis may be disposed closer to the aperture plane than the two base axes. A substantially planar middle lens section may be disposed on each side of the V-shaped bi-planar center lens section, wherein each substantially planar middle lens section may include one inner axis that is coaxial with a corresponding base axis of the center lens section and one outer axis that is closer to the aperture plane than the inner axis. The lens may also include two substantially planar outer sections, wherein each substantially planar outer section may include an outer edge that includes one of the two opposing lens edges, and an inner axis that is coaxial with the outer axis of the middle lens section.

In an example implementation, a lens may be configured to modify incident light, and may comprise a top edge, a bottom edge, a left edge and a right edge collectively defining a lens plane, and may further comprise two raised lens sections. Each raised lens section may comprise an elongated rectangular shape that substantially spans between the top and bottom lens edges and may be substantially parallel to the left and right lens edges. The raised lens sections may include a substantially planar face with a light-receiving side and a light-emitting side wherein the substantially planar face may define a raised lens section plane that is elevated at a distance above the lens plane. The raised lens sections may also include two opposing edges disposed at acute angles relative to the light receiving side of the substantially planar face, wherein each edge may form an overlay attachment feature.

The lens may further comprise three substantially planar sections comprising a middle planar section disposed between the two raised sections and two outer planar sections disposed on either side of the raised lens sections.

In an example embodiment, a lens may comprise a substrate defining a plane of incidence and having a first surface. The substrate may comprise a uniform transmittance region, at least one refraction feature pattern or shape region adjacent to the uniform transmittance region and defining a feature pattern or shape region comprising at least one refraction element.

The at least one refraction element may comprise, as applicable, one or more of:

a height variation of the first surface;

a thickness variation of the substrate;

a refractive index variation of the first surface;

a refractive index variation of the substrate;

a coating in contact with the first surface.

The at least one refraction element of the at least one refraction feature pattern or shape region may be configured to alter a transmittance angle of at least a portion of light input to the lens at an incidence angle with respect to the plane of incidence.

BRIEF DESCRIPTION OF THE FIGURES

FIG. 13A shows a top perspective view of the example embodiment of multi-plane light modifying element with optical film inserts as shown in FIG. 12B.

FIG. 13B shows a side view of the example embodiment of multi-plane light modifying element and optical film inserts as shown in FIG. 13A.

DETAILED DESCRIPTION

As LED light fixtures become more commonplace in the market and prices decline, manufacturers may seek to cut manufacturing costs to increase profits etc. The largest single cost in a light fixture may be the LED light source. LED strips may be a lower cost alternative to that of LED panel arrays, and therefore more economical. LED strips may typically be commercially available in approximate 11' or 22' lengths, and may typically have one or two rows of LEDs on each strip. There term "LED array" will herein be referred to as one or more elongated LED strips, wherein each LED strip comprises one or more rows of LEDs. When LED arrays are used as the light source, the pinpoint high intensity light from the LEDs may create a significant problem with respect to having the individual LEDs visible through a light fixture lens, often referred to as "pixelization". In addition, excessively bright areas in the vicinity of the LED arrays, and uneven or visually unpleasing light distribution within the light fixture and across the lens may be evident. If LED arrays are mounted flat on the back surface of the light fixture and facing the lens, there may be only a 3" to 3½" light source to lens distance in a typical "troffer" light fixture. Accordingly, there may be little that can be done within that distance in order to distribute the light evenly or acceptably within the fixture or across the lens, while retaining reasonable fixture efficiency.

Figure 4A:
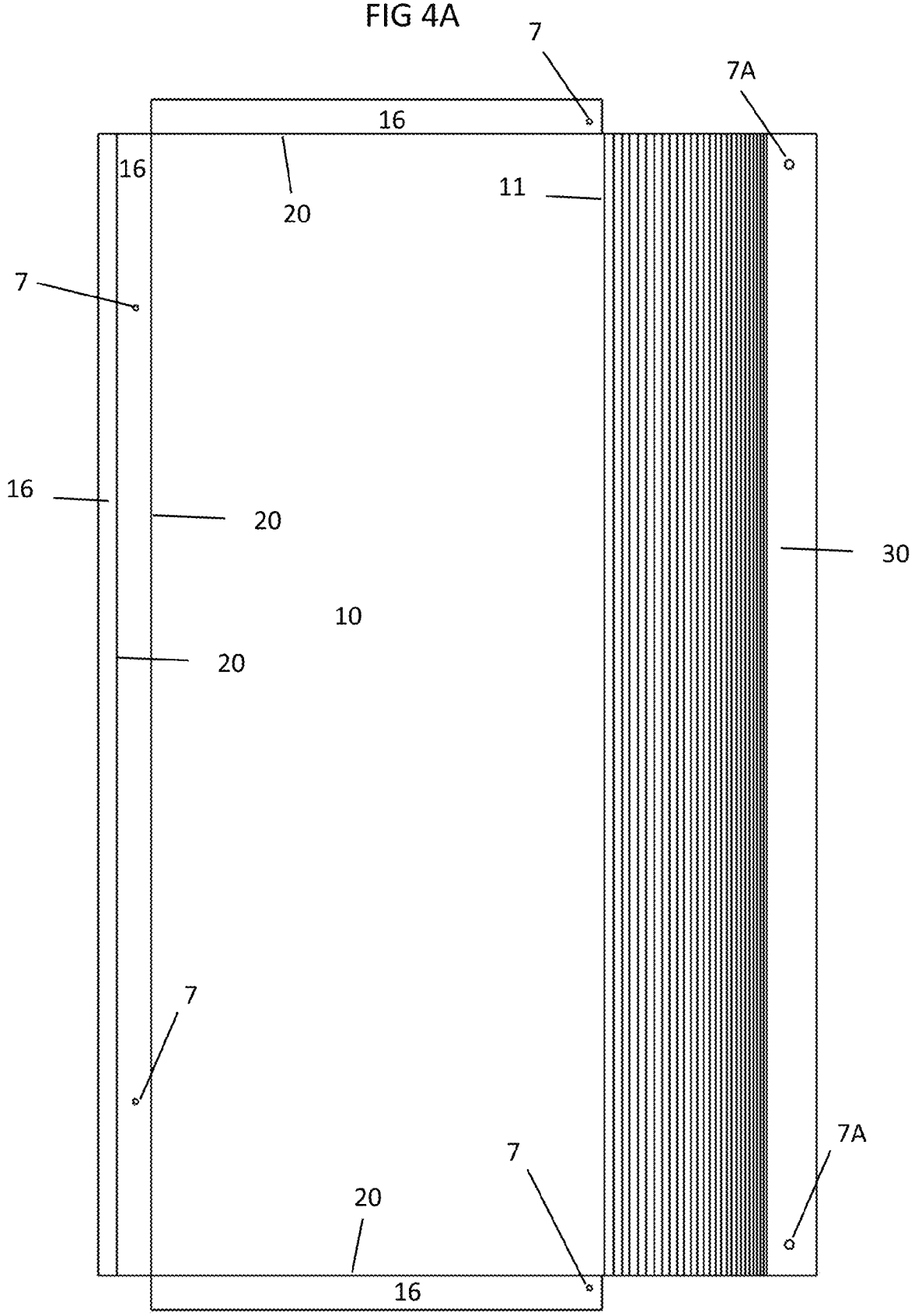
FIG. 4A depicts an optical film cutting and scoring template for one of the example embodiment light modifying element sections depicted in FIG. 3A
Figure 4B:
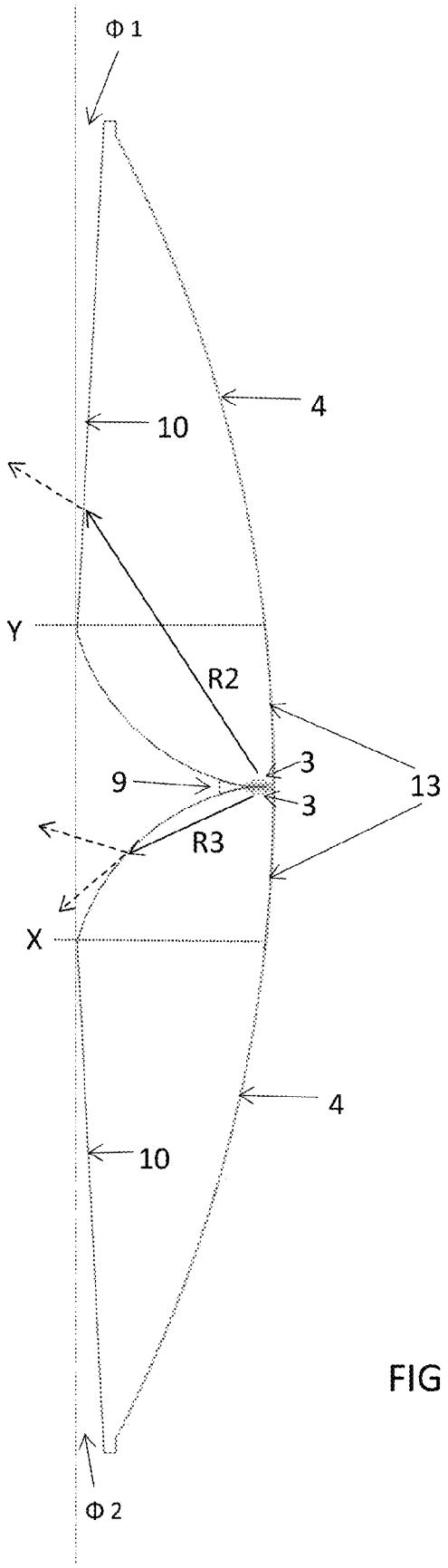
FIG. 4B depicts a light propagation diagram within an example embodiment of light fixture and light modifying element.

If two LED arrays were center mounted in a fixture as indicated by numeral 3 in FIG. 4B, and facing outwards towards curved reflector panels 4, and the back surfaces of the LED arrays were facing each other and in close proximity to each other as shown, then light may be distributed within the light fixture to a much greater extent than if the LED arrays were facing towards the aperture. While light distribution in the fixture may be significantly improved, there may remain a degree of illumination non-uniformity. The zone between line X and line Y may present a "problem area" wherein light directly from LED arrays 3, or light reflected from the reflector surface may create a "hotspot" area of brightness and or pixelization if a flat or relatively flat diffusion lens was utilized. Another problem may be that due to the space between the light emitting surfaces of opposing back-to-back LED arrays, there may be a strip of lower intensity light level above the two LED arrays, a "dead zone", which may create an objectionable shadow, dark area or color banding artifacts on a typical flat lens. Example embodiments herein may utilize the advantages of light fixtures with side facing LED arrays within a light fixture, while minimizing the effects of the problem area and dead zone.

Figure 1A:
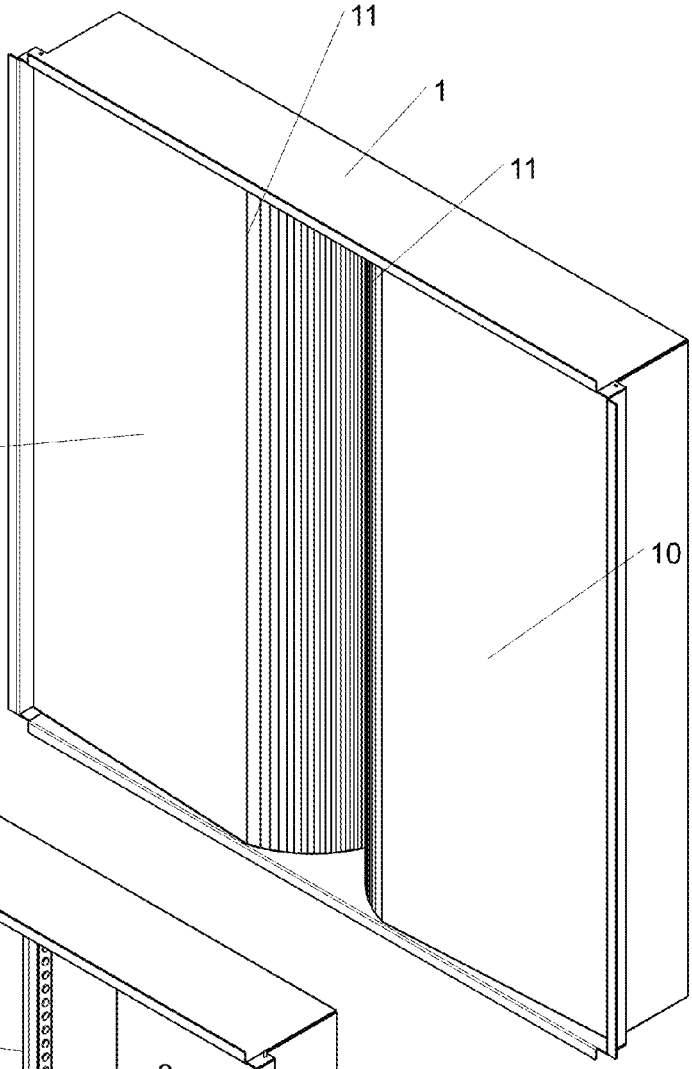
FIG. 1A depicts a perspective view of an example embodiment of light fixture and multi-plane light modifying element "LME".
Figure 1B:
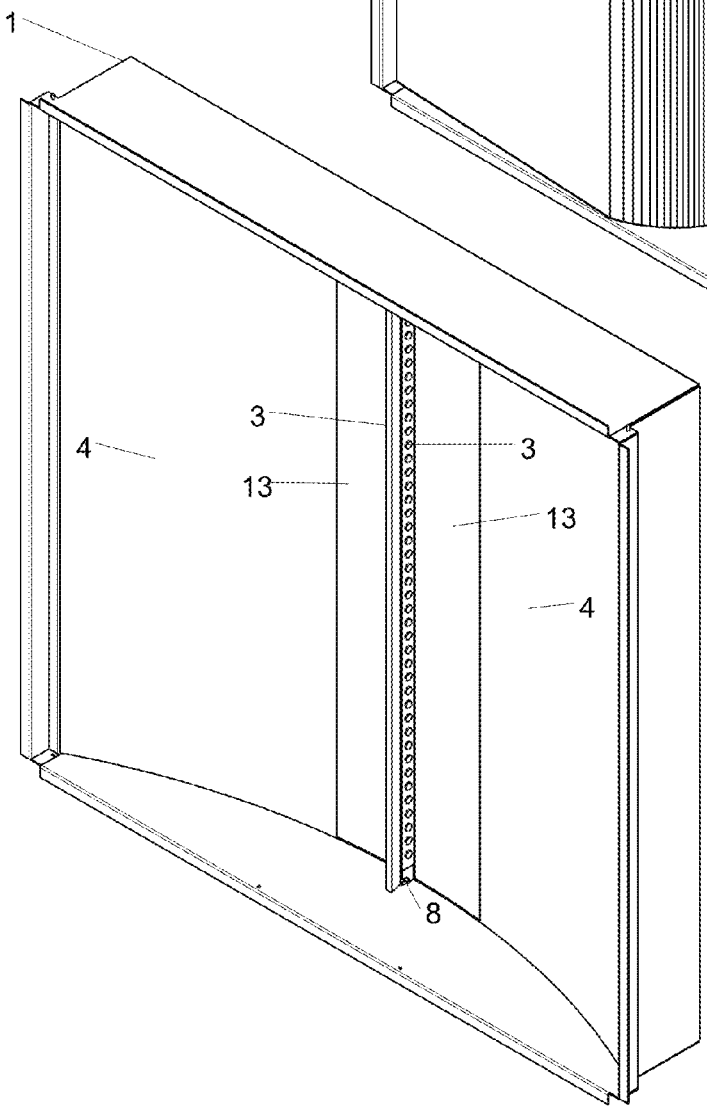
FIG. 1B depicts an exploded perspective view of the example embodiment of light fixture and LME depicted in FIG. 1A.
Figure 1C:
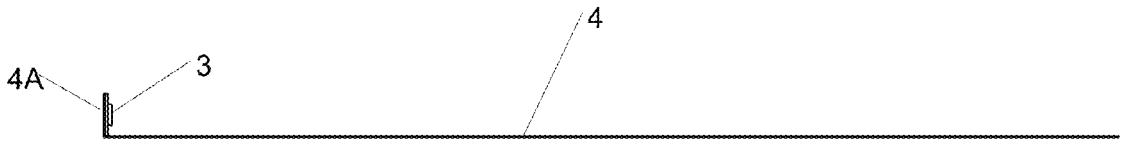
FIG. 1C depicts a side view of an example embodiment of reflector with integral heat sink before installation in a light fixture.
Figure 1D:
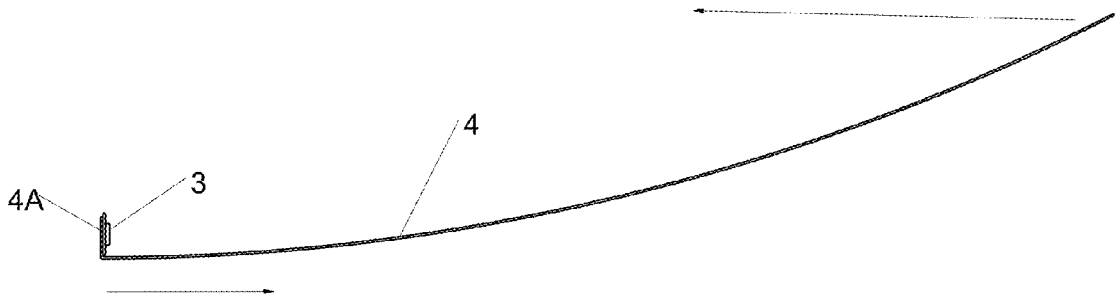
FIG. 1D depicts the reflector panel for the example embodiment of light fixture depicted in FIG. 1C after installation in a light fixture.

FIG. 1A depicts a perspective view of an example implementation of light fixture and light modifying element (LME), and FIG. 1B depicts a perspective view of the same, but with the LME 10 removed. In an example implementation, the advantages of even illumination of the LME 10, very good relative luminaire efficiency, and excellent visual aesthetic appeal may be realized utilizing only two LED arrays 3 as a light source. LED arrays 3 may be mounted vertically, wherein the light emitting face of each LED strip faces opposing sides of the light fixture enclosure 1, and may be mounted back-to-back in close proximity to each other, and in a central region of the inner back surface of the enclosure 1 as shown in FIG. 1B. Curved reflectors 4 are shown, however example embodiments of light fixtures with LED arrays mounted as described may also have flat reflecting surfaces, as shown in FIG. 1G for example. Although the uniformity of light distribution on the reflecting surfaces may be lower, it may nevertheless still be advantageous.

Example embodiments may utilize LED array mounting features configured from metal extrusions to retain linear LED arrays in their required orientations. Metal extrusions may be advantageous due to their low cost. FIG. 1H shows two back-to-back right angle extrusions 40 with LED arrays 3 mounted on opposing surfaces of the extrusions 40. The bases of the extrusions may attach to the inner back surface of the enclosure 1C as shown in FIG. 1G, utilizing any suitable fastener or fastening method. Right-angled extrusions may also be advantageous from a thermal perspective, wherein heat from the LED arrays may transfer through the horizontal bases of the extrusions through to the inner back surface of the enclosure 1C. FIG. 1I shows LED arrays 3 mounted on a single extrusion 41, wherein the single extrusion may mount and attach to the inner back surface of enclosure 1 in a similar manner as the right-angled extrusions. In an example embodiment, reflector panel retaining tabs 41B are configured on the extrusion base wherein a reflector panel may insert into each tab 41B, thus creating an attachment point with a relatively smooth transition between the extrusion and reflector panel. Single extrusions may have the advantage of a lower cost than two right-angled extrusions. Example embodiments of metal extrusions may comprise any other shape that may function to adequately dissipate heat from LED arrays, and to orient LED arrays in a light fixture as described.

Example embodiments of LED array mounting features may also comprise profiles similar to those described that utilize extrusions, but utilize folded sheet metal as an alternative. The functionality of example embodiments utilizing folded sheet metal may be very similar to that of extruded example embodiments; the choice of which fabrication method may primarily be based on cost and convenience considerations.

Example embodiments of LED array mounting features have been described as comprising metal. However, example embodiments may also comprise other materials that may have suitable mechanical and thermally conductive properties, just as plastics, composites, or polymers.

In an example embodiment, LED arrays may mount directly on a reflector panel that also functions as a heat sink to dissipate the heat generated by the LED arrays, that may have a lower manufacturing and assembly cost compared to utilizing extrusions as described. Referring to FIG. 1C, the reflector panel 4 may comprise a flat panel of a suitable substrate such as metal for example, with an approximate 90-degree fold on one side, that may create an LED array-mounting flange 4A, whereon the LED strip 3 may mount. A light fixture enclosure may include four or more mounting features such as slots, catches, folds etc. (not shown) wherein each flat reflector panel 4 may be held in a curved compressed disposition by the four or more mounting features. Referring to FIG. 1D, when the reflector panels 4 are compressed in the direction of the arrows and inserted in a light fixture, they may form a curved shape as shown. The reflector panel 4 may comprise LED array mounting flange 4A, and may have the advantage of low manufacturing and assembly costs. In an example embodiment, the reflector panels 4 may have reflective white paint on their reflection surfaces, or may be coated with any suitable diffuse reflective coating or surface. High efficiency diffuse reflection surfaces such as White 97 manufactured by White Optics may offer superior optical efficiency.

In an example embodiment, a reflector panel with integral LED array mounting flange may be utilized wherein the panel may have a curved shape already formed into the panel during a manufacturing process such as stamping or extruding.

Example embodiments of light fixtures described may comprise alternate LED mounting angles between vertical and horizontal which may function suitably with a given lens configuration. FIG. 1J shows a side view of reflector panels 4 (not to scale for illustrative purposes) that are similar to an example embodiment shown in FIGS. 1C and 1D, except that the LED array mounting flanges 4A are angled at an example alternate angle of approximately 45 degrees. LED arrays 3 may be mounted on LED array mounting flanges 4A. When an example embodiment of lens similar to that shown in FIG. 1A is utilized with the described example alternate LED-mounting angle of 45 degrees, luminaire efficiency may increase due to lower light losses due to reflections within the light fixture. Although brightness in the central area of the lens (which may be subsequently described) will increase, it may nevertheless be suitable for many applications. By altering the LED array mounting angle relative to the plane of the inner back surface of an enclosure back, for example between 80 degrees as shown by $\alpha$ in FIG. 1J, and 135 degrees as shown by angle $\beta$ in FIG. 1J, the desired tradeoff between brightness in the central lens area and luminaire efficiency may be configured for a given application.

In an example implementation of light fixture similar to that as previously described and shown in FIG. 1B, two or more LED arrays may be mounted back-to-back in close proximity to each other, and in a central region of the inner back surface of an enclosure, wherein the plane of the light emitting face of each LED strip may be oriented at alternate angle. In an example implementation of light fixture, two or more LED arrays may be mounted back-to-back in close proximity to each other, and in a central region of the inner back surface of an enclosure, wherein the plane of the light emitting face of each LED strip may be oriented within a range of 80 degrees and 90 degrees relative to the plane defined by the inner back surface of the enclosure. In an example implementation of light fixture, two or more LED arrays may be mounted back-to-back in close proximity to each other, and in a central region of the inner back surface of an enclosure, wherein the plane of the light emitting face of each LED strip may be oriented within a range of 100 degrees and 90 degrees relative to the plane defined by the inner back surface of the enclosure. In an example implementation of light fixture, two or more LED arrays may be mounted back-to-back in close proximity to each other, and in a central region of the inner back surface of an enclosure, wherein the plane of the light emitting face of each LED strip may be oriented within a range of 110 degrees and 100 degrees relative to the plane defined by the inner back surface of the enclosure. In an example implementation of light fixture, two or more LED arrays may be mounted back-to-back in close proximity to each other, and in a central region of the inner back surface of an enclosure, wherein the plane of the light emitting face of each LED strip may be oriented within a range of 120 degrees and 110 degrees relative to the plane defined by the inner back surface of the enclosure. In an example implementation of light fixture, two or more LED arrays may be mounted back-to-back in close proximity to each other, and in a central region of the inner back surface of an enclosure, wherein the plane of the light emitting face of each LED strip may be oriented within a range of 135 degrees and 120 degrees relative to the plane defined by the inner back surface of the enclosure.

Example embodiments of light fixtures with alternate LED mounting angles as described may be utilized with any mounting features as described. For example, extrusions may be created with LED mounting surfaces configured with the desired alternate LED mounting angles.

In an example embodiment as shown in FIG. 1B, the driver for the LED arrays 3 and line voltage wires may be mounted underneath either of the reflector panels 4. If the reflector panels comprise a substrate (such as metal) that is properly UL (or similar) rated, the reflector panels 4 may also function as the "wire tray" which houses the line voltage wires and LED driver. This may have cost saving advantages of the enclosure not having to have a separate wire tray.

Example embodiments with back-to-back LED array configurations as described may also be configured in light fixtures without curved reflectors therein, as previously described. For example, FIG. 1G shows an example embodiment with no separate reflectors. The light fixture enclosure 1 may comprise two back-to-back LED arrays 3 mounted on right-angled extrusions 40 that are mounted on the inner back surface of the enclosure 1C as previously described. Although the light distribution within the light fixture and on an LME surface may not be as even, it may nevertheless still produce exemplary results.

Referring to FIG. 1A, LME 10 may comprise two separate pieces, or may comprise only one piece; the determination may be based on which configuration may achieve the lowest manufacturing cost, ease of manufacture, ease of installation etc. The LME 10 may comprise a clear or translucent substrate configured to modify light from LED arrays 3. The substrate may include any type of substrate that may provide suitable structure and optical properties for the intended application. Examples of suitable substrates may include polycarbonates or acrylics. The substrate may have associated with it any type of light modifying features that may be suitable for an intended application. In one example implementation, the substrate may have a light modifying layer deposited on either or both surfaces. In one embodiment, the light modifying layer(s) may include diffusion particles such as glass beads. In other example implementations, the substrate may have light modifying elements incorporated within the substrate itself, such as diffusion particles for example. In certain example implementations, the substrate may have features formed onto its outer surface, such as prismatic or Fresnel features. In accordance with various example implementations of the disclosed technology, the substrate may have various combinations of light modifying features, for example, particles incorporated into the substrate itself and a light modifying layer deposited on one or more surfaces. In certain example implementations, the substrate may include an optical film overlay.

In an example embodiment, the single LME or two LME sections may be fabricated by any suitable method, such as injection molding, vacuum forming or extrusion methods for example. An example embodiment of LME may be fabricated with its final shape as shown by the LME 10 in FIG. 1A. FIG. 1K may show a partial side view of an example embodiment of LME configured from a single piece of a rigid or semi rigid clear or translucent substrate as described. The lens mounting area 30 may nest between LED array mounting features without any fasteners provided the LME may be otherwise securely attached to the light fixture.

In example embodiments wherein an LME has enough flexibility such that sufficient access to the inside of the light fixture can be obtained, the LME may be fastened to the LED array mounting features. In an example embodiment as shown in FIG. 1L, (LME 10 has been truncated for illustrative purposes) lens mounting area 30 of each LME 10 may be configured with a hole on each corner wherein the holes may correspond to the locations of slots on the LED array mounting features 40. A trim strip 9 (that may be subsequently described) may be configured with holes in locations corresponding to the holes in the LMEs 10. The two LMEs 10 and the trim strip 9 may be placed together and in between the LED array mounting features 40 wherein all the holes are aligned, and a fastener such as a pin, rivet, screw or any suitable fastener arrangement (for example screw 31 and nut 32) may be inserted through the holes, thus securing the LME assembly to the light fixture.

Figure 1E:
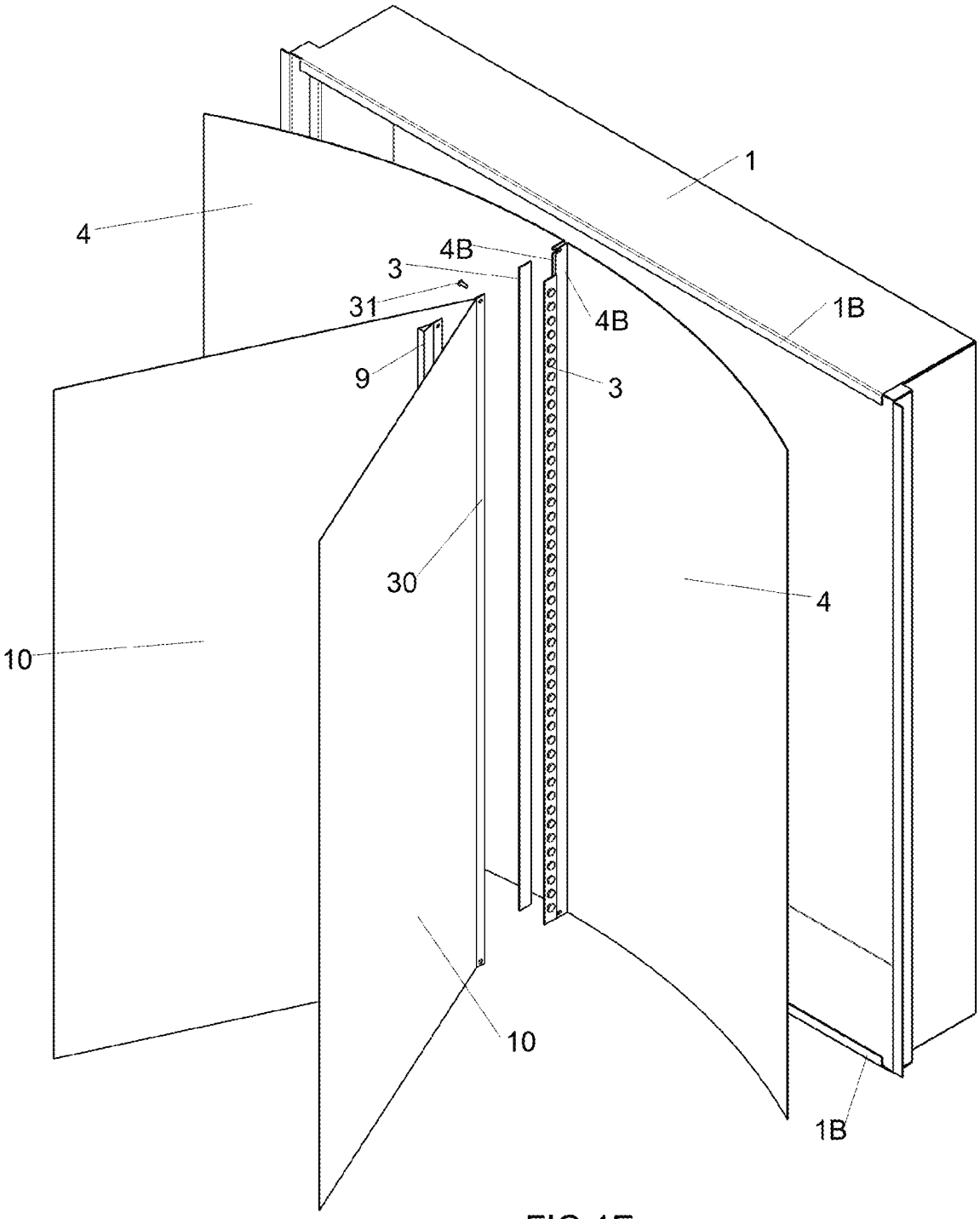
FIG. 1E shows an exploded perspective view of an example embodiment of light fixture and light modifying element in an uncompressed state.
Figure 1F:
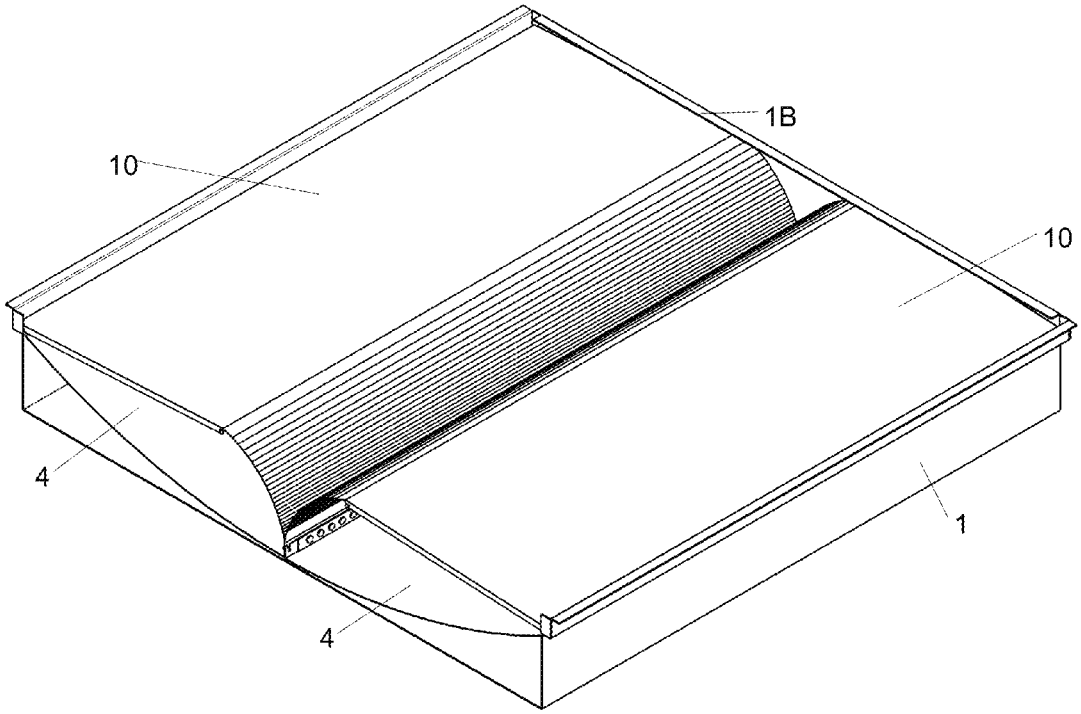
FIG. 1F shows a cut-away perspective view of an example embodiment of light fixture and light modifying element.
Figure 1G:
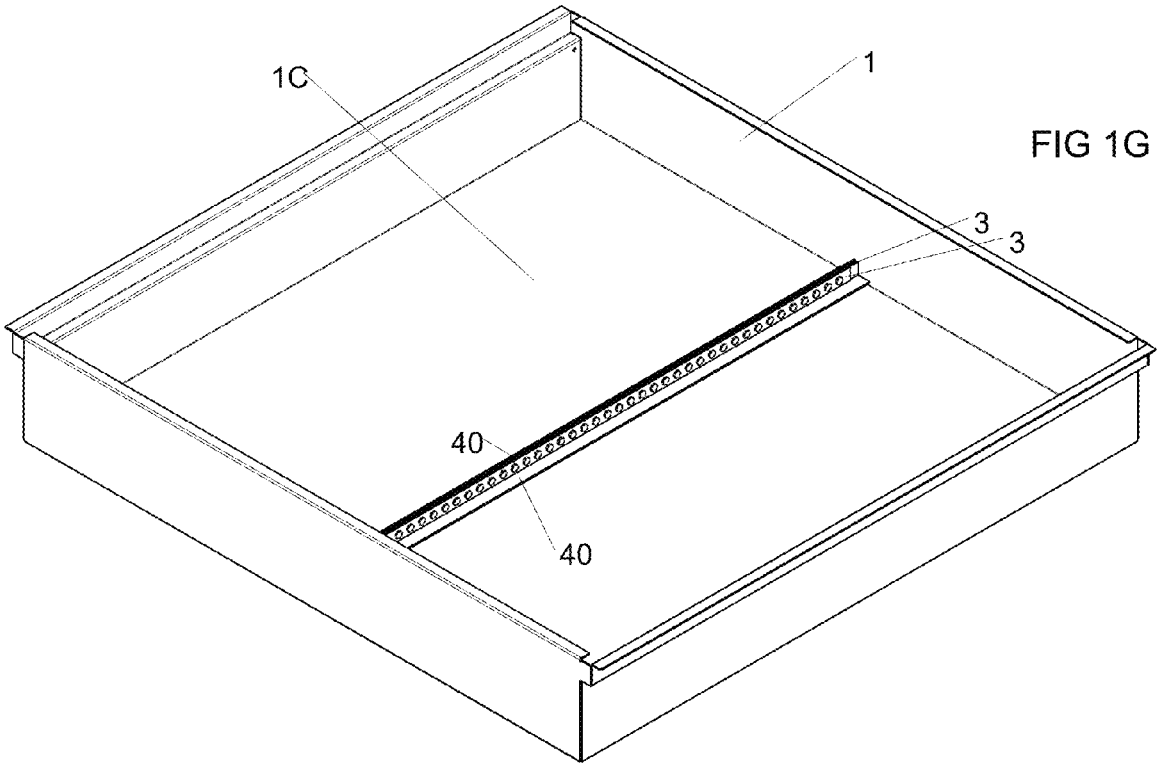
FIG. 1G shows an example embodiment of light fixture with an example embodiment of an LED array-mounting feature.
Figure 1H:
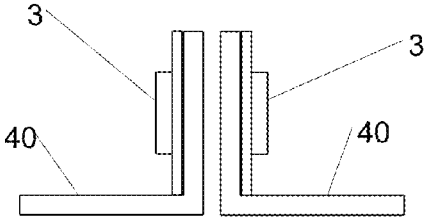
FIG. 1H shows a profile view of an example embodiment of an LED array-mounting feature.
Figure 1I:
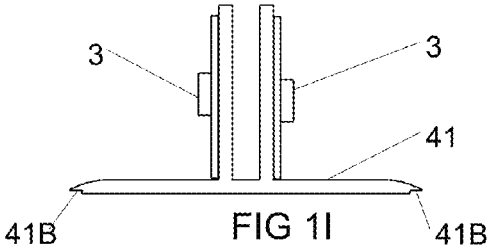
FIG. 1I shows a profile view an example embodiment of an LED array-mounting feature.
Figure 1J:
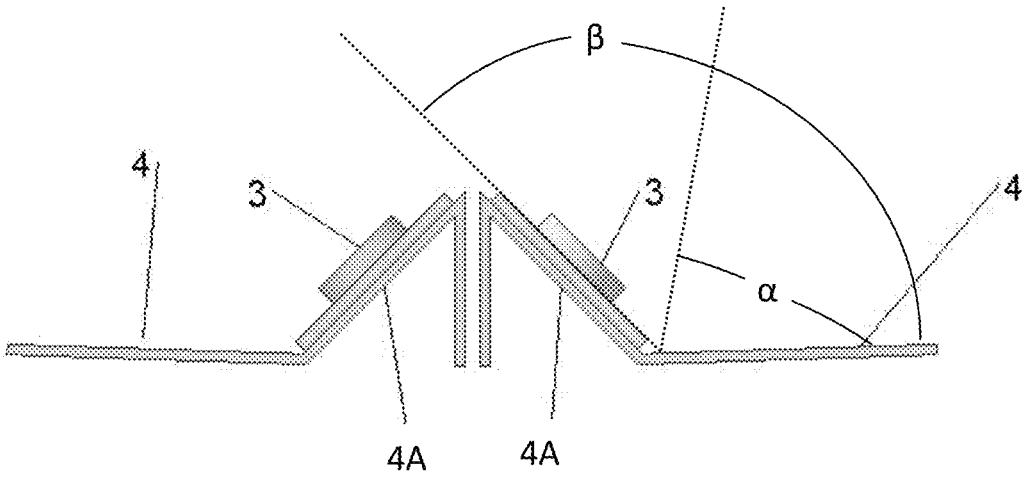
FIG. 1J shows a profile view an example embodiment of LED array mounting feature.
Figure 1K:
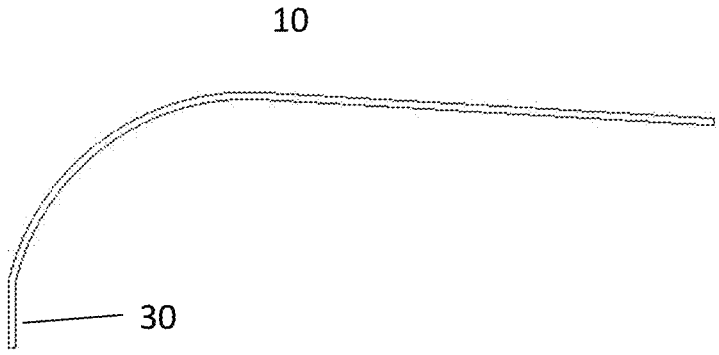
FIG. 1K shows a profile view of an example embodiment of light modifying element configured from a single piece of a rigid or semi rigid clear or translucent substrate.
Figure 1L:
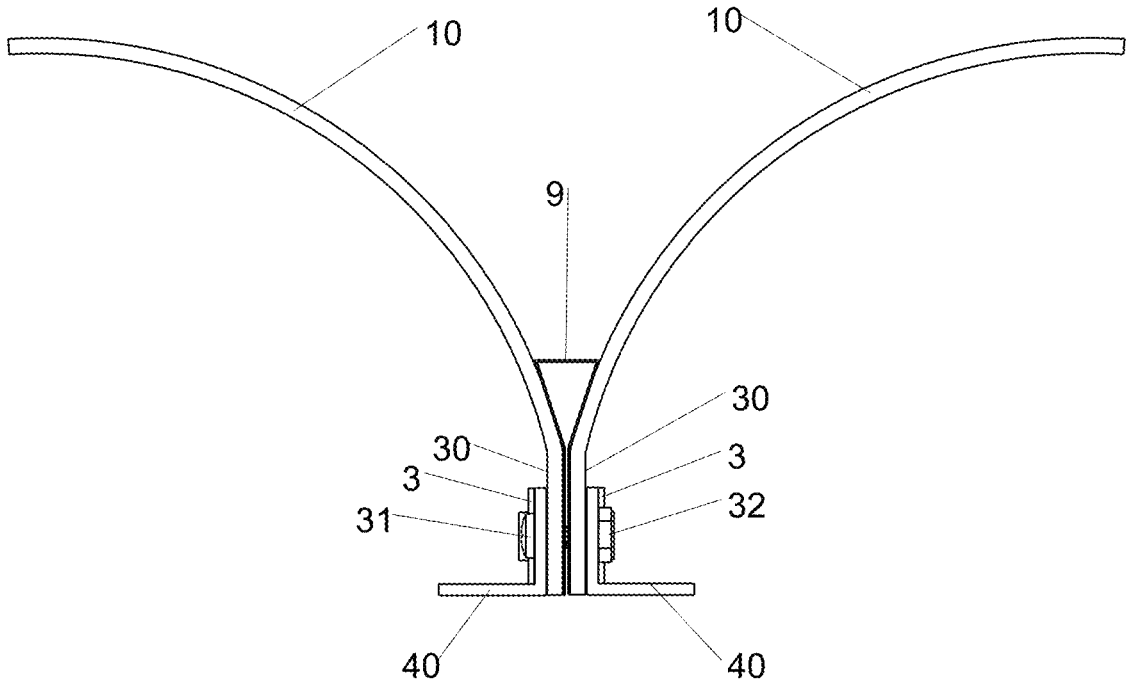
FIG. 1L shows a close-up side view of an example embodiment of light modifying element disposed between two LED array-mounting features.

Example embodiments of LME may be fabricated with a flat flexible substrate as shown in FIG. 1E, which shows an exploded perspective view of an example embodiment of LME. The flat flexible substrate may include any material that may possess the optical and mechanical properties required for an intended application, and may comprise any types previously described, and may also include certain optical films. The reflector panels 4 may be shown in their compressed curved state rather than their normal flat state. The LMEs 10 which may comprise a flat flexible substrate, may have mounting edges 30, which insert between LED array mounting flanges 4B on the reflector panels 4, and fasten with pins, rivets, screws or any suitable fastener 31 to the LED mounting flanges 4B through slots 8, similar to a previously described example embodiment. Trim strip 9 may also be indicated. Once attached to the LED mounting flanges 4B, the LMEs 10 may subsequently be laterally compressed, and the top and bottom LME 10 edges may be inserted under the two enclosure lip flanges 1B, wherein the LMEs attachment to the LED mounting flanges 4B, the enclosure lip flanges 1B, and the side edges of the enclosure 1 may function to retain the LMEs 10 in a compressed state as shown in FIG. 1F. FIG. 1F may show a cutaway perspective view of an example embodiment as shown in FIG. 1E, showing the compressed LME sections 10 and the top edges of the LME sections 10 disposed beneath enclosure lip flange 1B of enclosure 1. Reflector panels 4 may also indicated.

The example embodiment just described may show the LME sections 10 being retained in their compressed curved state by enclosure lip flanges 1B. However, any mechanical means may be utilized to retain the shape of the LME sections that may be cost effective and visually acceptable. For example, fasteners, clips, detachable extrusions, folds in the enclosure sheet metal etc. may be utilized. For example, the requirement to have the LME removable once the fixture is installed may dictate the preferred mechanical means of retention of the LME sections 10.

FIG. 4B may show a simplified side cross section view of an example embodiment, with reflector panels 4 and LME 10 similar to that shown in FIG. 1A and 1B. As disclosed in a related application, there may be a cumulative effect of the interaction of light with a diffusion lens surface, wherein light striking the surface at lower angles of incidence, such as light ray R3 on the curved section of the LME 10, may undergo additional increased scattering and subsequent reflection, refraction and absorption than the light rays striking the LME 10 at angles closer to the surface normals of LME 10, such as light ray R2. As shown in FIG. 4B, the curved LME 10 surfaces near the dead zone are generally at steep angles relative to the normals of the LED arrays 3. Due to the optical properties of diffusion lenses as previously described with respect to smaller angles of incident light, the scattering and/or total internal reflection of the light from the light source may be highest in the curved sections of the LME 10 than on the planar sections. Accordingly, the curved sections of the LME 10 in the problem area between lines X and Y may have the effect of decreasing transmitted relative light levels that exit the LME 10 lens in the problem area.

Trim strip 9 may be utilized as an important visual aesthetic feature in the center between each LME 10 as a decorative trim and to hide the joint between each LME 10 section. Perhaps most importantly, the trim strip 9 may be configured with the appropriate size to hide or eliminate the dead zone.

Still referring to FIG. 4B, each reflector panel 4 may include a strip of prismatic film 13 in the problem area that may be parallel and adjacent to each LED strip 3. The prismatic film 13 may be oriented with the structured surface facing away from the reflectors 4, and the prism rows aligned parallel to the LED arrays 3. The prismatic film strips 13 may have the effect of diverting a significant portion of the light incident on its surface towards other areas between the LME's 10 and the reflector panels, and away from the problem area. The prismatic filmstrips 13 may also be shown in FIG. 1B.

Another feature of an example embodiment as shown in FIG. 4B may be that the planar sections of each LME 10 may be angled away from the aperture plane of the light fixture (indicated by the dotted line), as shown by angles Φ1 and Φ2. The effect may be that direct light from the LED arrays incident on those planar LME surfaces (light ray R2 for example) may have greater angles of incidence (closer to the surface normals) than would have otherwise occurred with horizontal LME planar sections. The cumulative result may be greater light output in those areas, increased fixture efficiency, and a widened light dispersion pattern.

An example embodiment of lenses with one or more refraction features may now be described. An example embodiment of lens may comprise a substrate defining a plane of incidence and having a first surface. The substrate may comprise a uniform transmittance region and at least one refraction feature pattern or shape region adjacent to the uniform transmittance region and defining a refraction feature pattern or shape region. A refraction feature pattern or shape region may comprise at least one refraction element, and the at least one refraction element may comprise, one or more of:

a height variation of the first surface;
a thickness variation of the substrate;
a refractive index variation of the first surface;
a refractive index variation of the substrate; and
a coating in contact with the first surface.

The at least one refraction element of the at least one refraction feature pattern or shape region may be configured to alter a transmittance angle of at least a portion of light input to the lens at an incidence angle with respect to the plane of incidence.

A refraction feature pattern or shape region may comprise any shape or pattern, for example, a square, a circle, a grouping of parallel linear elements, a rectangle, a shape comprising a gradient, etc. The shape or pattern on a lens, and may be configured to modify light from a light fixture in a more efficient manner than with just the lens, or to create a more visually pleasing light output. For example, the shape or pattern may function to lower pixelization and increase lamp hiding on an LED light fixture. For example, the pattern or shape may function to create a region of higher density diffusion particles disposed over top of an LED light source. The shape or pattern may be also be configured to add a visual aesthetic or an ornamental design feature to an example embodiment of lens. Refraction elements may be formed onto any type of lens, including lenses comprising a clear or translucent substrate that may be either rigid or semi-rigid, or lenses comprising optical film.

Refraction elements may be formed on an example embodiment of lens on either the front or back lens surface, or on both surfaces. They may comprise protuberances or grooves on a lens surface with any type of cross-sectional profile that may enable a desired light refraction characteristic, for example, prismatic, Fresnel, curves etc., that may be formed or molded into the substrate. Refraction elements may comprise variations in a surface configuration of the lens. For example, a lens with a surface coating, for example a diffusion coating, may not have the coating applied to the surface areas of the refraction features. Alternatively the refraction features may have an additional coating applied to those areas. Surface variations as described may be created by etching, printing, or any other method that may achieve suitable characteristics. For example, a lens formed utilizing an injection molding process may have refraction elements formed by different textures created in corresponding areas of the mold cavities. Refraction elements may comprise areas of a lens surface that may have ink or diffusion elements applied utilizing printing techniques or methods such as an inkjet or laser printer for example. Refraction features may be created by a computer-controlled laser that may etch lines, patterns, textures or shapes onto a lens surface, whereby creating a surface texture or depth in those areas that may be different from the rest of the lens surface. Lenses may have one or more optical film overlays wherein the refraction features may be formed on the one or more optical film overlays. Lenses may have one or more optical film overlays wherein the refraction features may comprise only the optical film overlays. On optical film lenses, refraction elements may be laser etched, scored, printed, heated, stamped, embossed etc. on an optical film surface. For example, a stamping die may create score lines or a textured pattern area on a film surface.

Any refraction elements described may also be configured to be opaque or semi-opaque.

Figure 20:
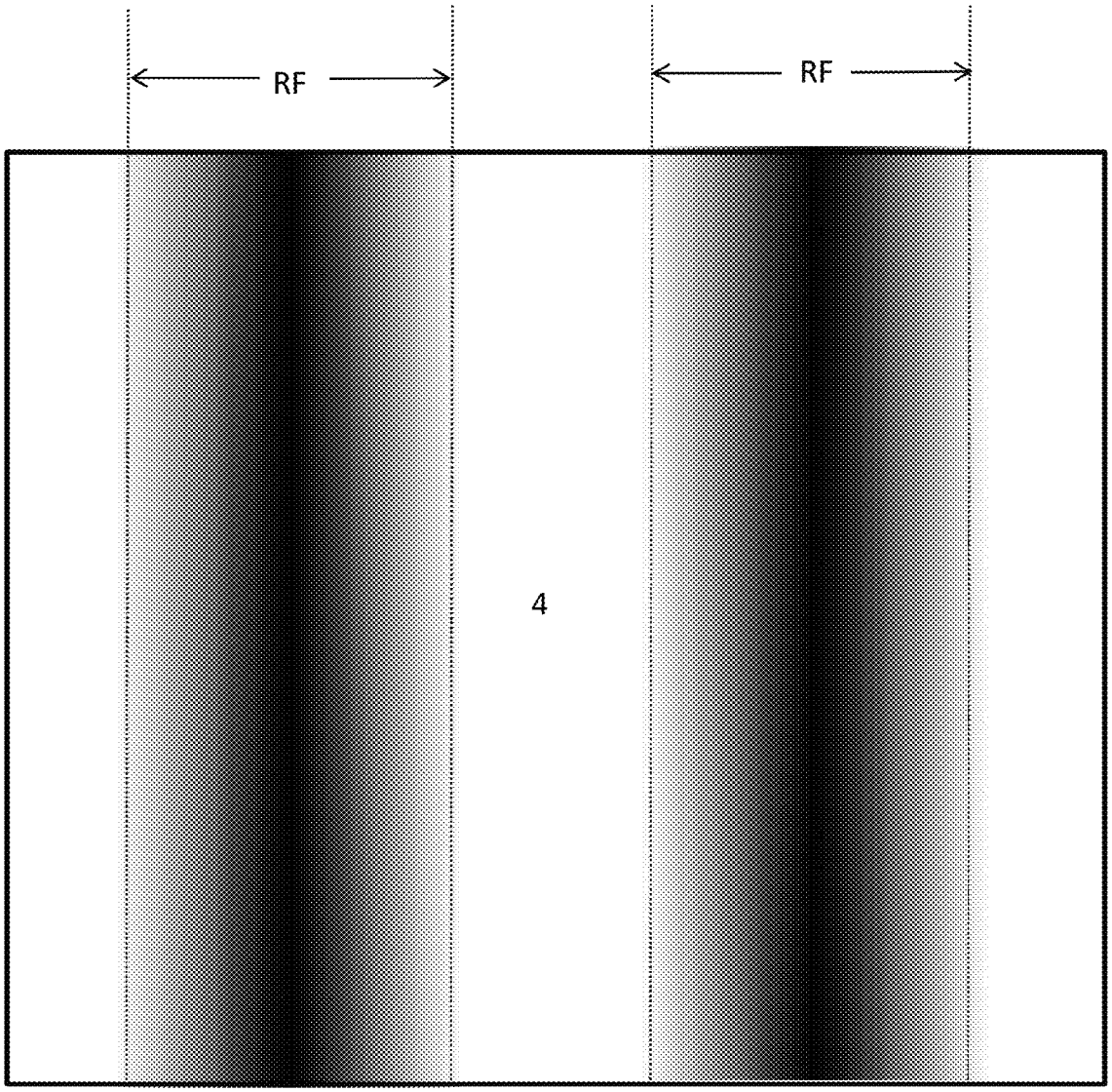
FIG. 20 shows a perspective view of an example embodiment of lens comprising printed refraction features.

An example embodiment of lens with refraction features that may be applied by one or more methods as described may be shown in FIG. 20. Lens 4 may comprise an optical film lens, or a lens comprising a clear or translucent substrate, wherein refraction features RF (the areas between each set of dotted lines) comprise a layer of particles that have been printed on a surface of the lens by a printing process, technique or method, or surface textures created by other methods as previously described. In an example embodiment, each refraction feature RF may have a gradient pattern wherein the particles (or texture etc.) may be more dense and or more closely spaced in the center region of each refraction feature RF and the particles (or texture etc.) may become less dense and or spaced further apart towards the outer edges of each refraction feature RF. In an example embodiment, each refraction feature RF may have a gradient pattern wherein a layer of particles (or texture etc.) may be thicker in the center region of each refraction feature RF and the layer of particles (or texture etc.) may become thinner towards the outer edges of each refraction feature RF. Each refraction feature may be printed utilizing any suitable material, for example, diffusion particles such as glass beads, or white ink with reflective particles such as titanium dioxide.

In an example embodiment, metallic or white particles may be printed on any surface of a lens with an inkjet printer. For example, a large format printer such as the VersaCAMM VSI series by the Roland Corp. may be configured to print highly reflective silver metallic ink as well as white ink. Solid or gradient refraction features as previously described may be able to be printed in any combination of white and silver. The density of printed refraction features may be varied to obtain the required lamp hiding, diffusion, and luminaire efficiency. Additionally, silver or opalescent colors may function to add a unique aesthetic quality to an example embodiment of lens.

The pattern may be etched onto the lens surface with a laser beam or created in an injection molding process as described.

Figure 10:
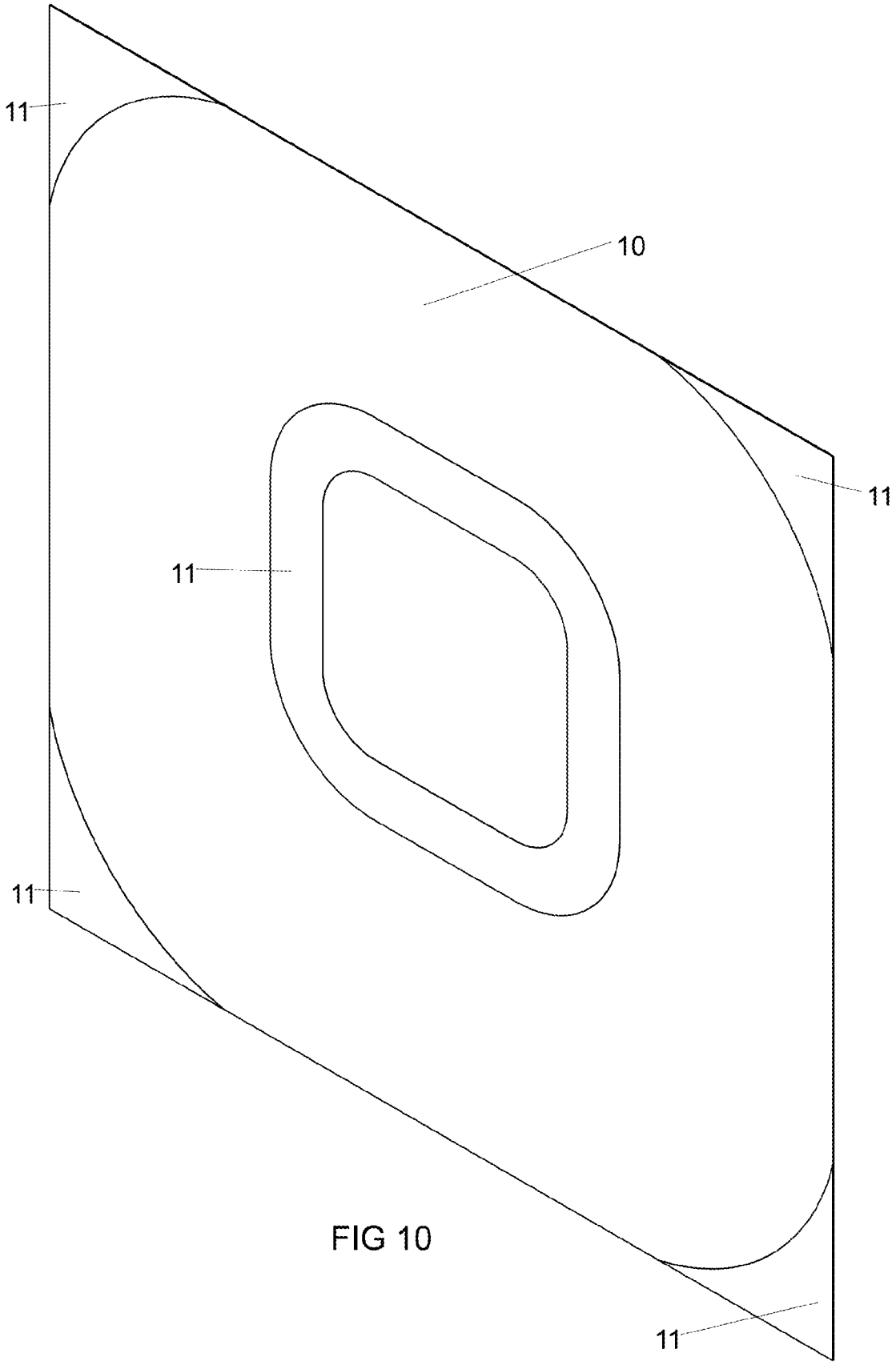
FIG. 10 shows a lens with example embodiments of light refraction features disposed thereon.

An example embodiment of lens with refraction features that may be applied by one or more methods as described may be shown in FIG. 10. Lens 4 may comprise an optical film lens, or a lens comprising a clear or translucent substrate. The lens may attach to light fixture wherein LED arrays may be mounted in a square pattern inside the fixture. Refraction features 11 may comprise a layer of particles that have been printed on a surface of the lens by a printing process, technique or method, or surface textures created by other methods as previously described. Each refraction feature may be printed utilizing any suitable material, for example, diffusion particles such as glass beads, or white ink with reflective particles such as titanium dioxide. The pattern may be etched onto the lens surface with a laser beam or created in an injection molding process as described. The center refraction feature 11 may be configured wherein it may be disposed over top, or adjacent to the square mounted LED arrays.

Figure 11:
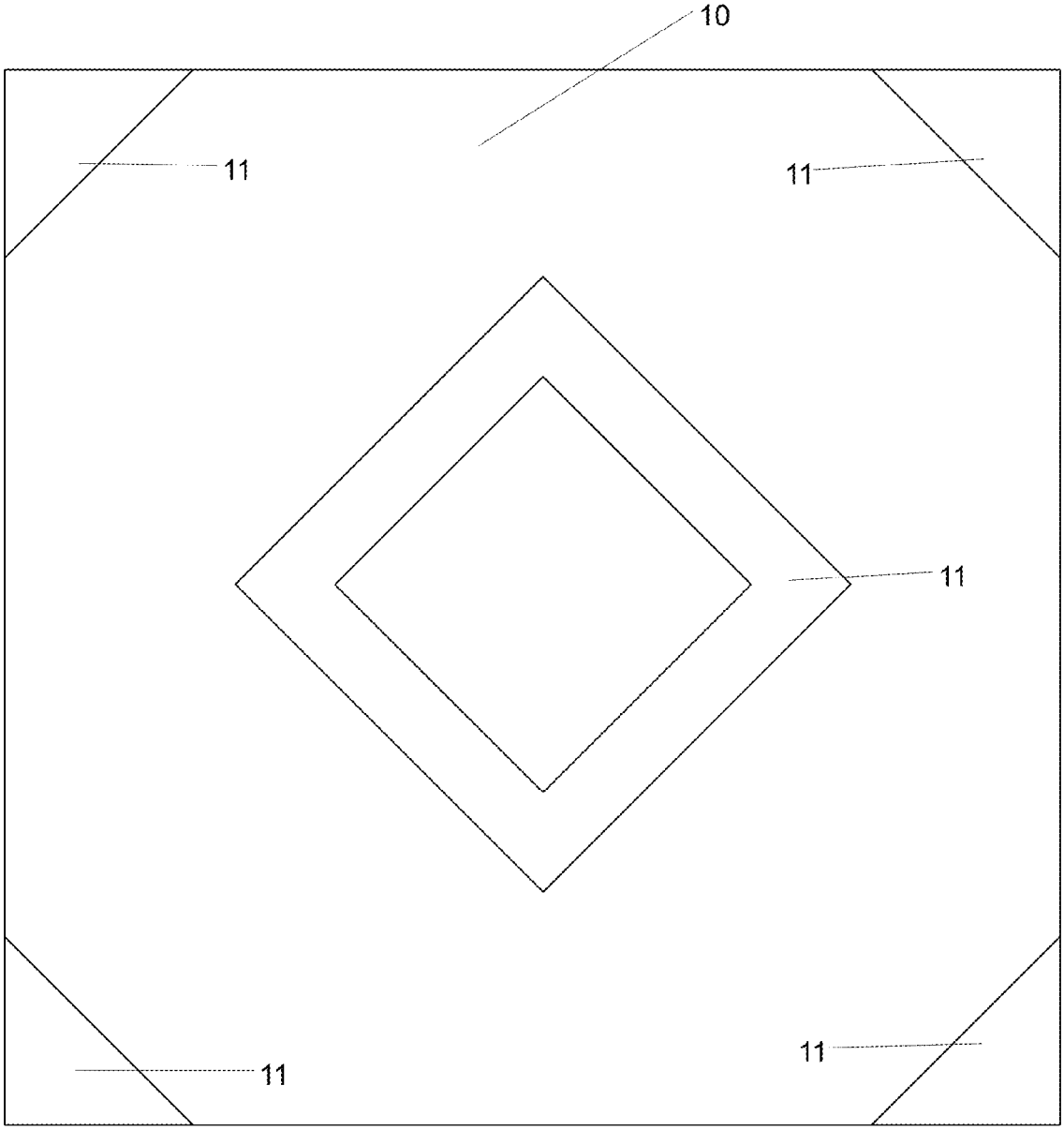
FIG. 11 shows a lens with example embodiments of light refraction features disposed thereon.

An example embodiment of lens with refraction features that may be applied by one or more methods as described may be shown in FIG. 11. Lens 4 may comprise an optical film lens, or a lens comprising a clear or translucent substrate. The lens may attach to light fixture wherein LED arrays may be mounted in a diamond pattern inside the fixture. Refraction features 11 may comprise a layer of particles that have been printed on a surface of the lens by a printing process, technique or method, or surface textures created by other methods as previously described. Each refraction feature may be printed utilizing any suitable material, for example, diffusion particles such as glass beads, or white ink with reflective particles such as titanium dioxide. The pattern may be etched onto the lens surface with a laser beam or created in an injection molding process as described. The center refraction feature 11 may be configured wherein it may be disposed over top, or adjacent to the diamond mounted LED arrays.

In the example embodiment shown in FIG. 20, each refracting feature RF may be configured on a lens wherein once the lens may be installed on a light fixture, each refracting features may be disposed and centered over top of two linear light sources. In a commercially available light fixture, a typical lens may have a constant homogenous diffusion level throughout the surface area of the lens. The level of diffusion may have been selected to provide adequate diffusion and lamp hiding in the areas of the lens disposed nearest the light source. However as a result, there are areas on the lens that are further away from the light source that may not require as high a diffusion level. Accordingly, these areas may be unnecessarily restricting the light output, and therefore unnecessarily lowering the overall luminaire efficiency. In the example embodiment as shown and described from FIG. 20, the level of diffusion within the refracting feature RF may be scaled inversely to the light intensity incident on the lens surface, which may provide an overall optimal diffusion level, which may significantly increase luminaire efficiency. Refracting features as described may also function to add aesthetic visual appeal and uniqueness to a lens that may be an important element in the commercial success of a lens or light fixture.

In example embodiments wherein the refraction elements may comprise grooves or protuberances, thin elongated linear shapes may be utilized that may function to increase lamp hiding and to add an appealing visual aesthetic. The refraction features may be oriented parallel to an LED arrays or linear light source, wherein direct light from the linear light source may strike the sides of the refraction elements, which may create more pronounced refraction of the light source. Any other groupings or orientations of linear refraction lines may be utilized that may add the desired visual aesthetics and photometric properties.

In an example embodiment as shown in FIG. 1A, a lens may contain refraction features comprising groupings of refraction elements that may comprise thin elongated linear shapes. The curved sections of the LME 10 sections may include a grouping of linear refraction elements 11. The refraction elements 11 may function to help blend and obscure the presence of the light source 3 in the problem area, increase the perceived depth of the LME, and may create a more visually appealing look. The space between individual refraction elements 11 may be increased as the distance from the lenses axis of symmetry increases. Since the brightness on the LME 10 surface may be higher nearest the LED arrays 3, and decrease as the distance from the LED arrays increases, the progressively increasing space between the refraction elements 11 may function to aid in visually masking this higher brightness in a visually appealing way.

As recited in the "Related Applications" section, this application is a continuation-in-part of PCT Patent Application PCT/US2013/039895 entitled "Frameless Light Modifying Element" filed May 7, 2013, and is also a continuation-in-part of PCT Patent Application PCT/US2013/059919 entitled "Frameless Light Modifying Element" filed Sep. 16, 2013. As described, various example embodiments of self-supporting optical film lenses were included which incorporate "edge trusses" on two or more edges of an optical film piece. Each edge truss may include one or more sides configured from a corresponding fold in the optical film, wherein at least one of the one or more sides is configured at an angle relative to the lens plane to impart support to the lens and to resist deflection of each edge truss. In example embodiments, edge trusses may impart sufficient structural rigidity to pieces of optical film to support portions of the optical film in a substantially planar configuration.

Figure 2:
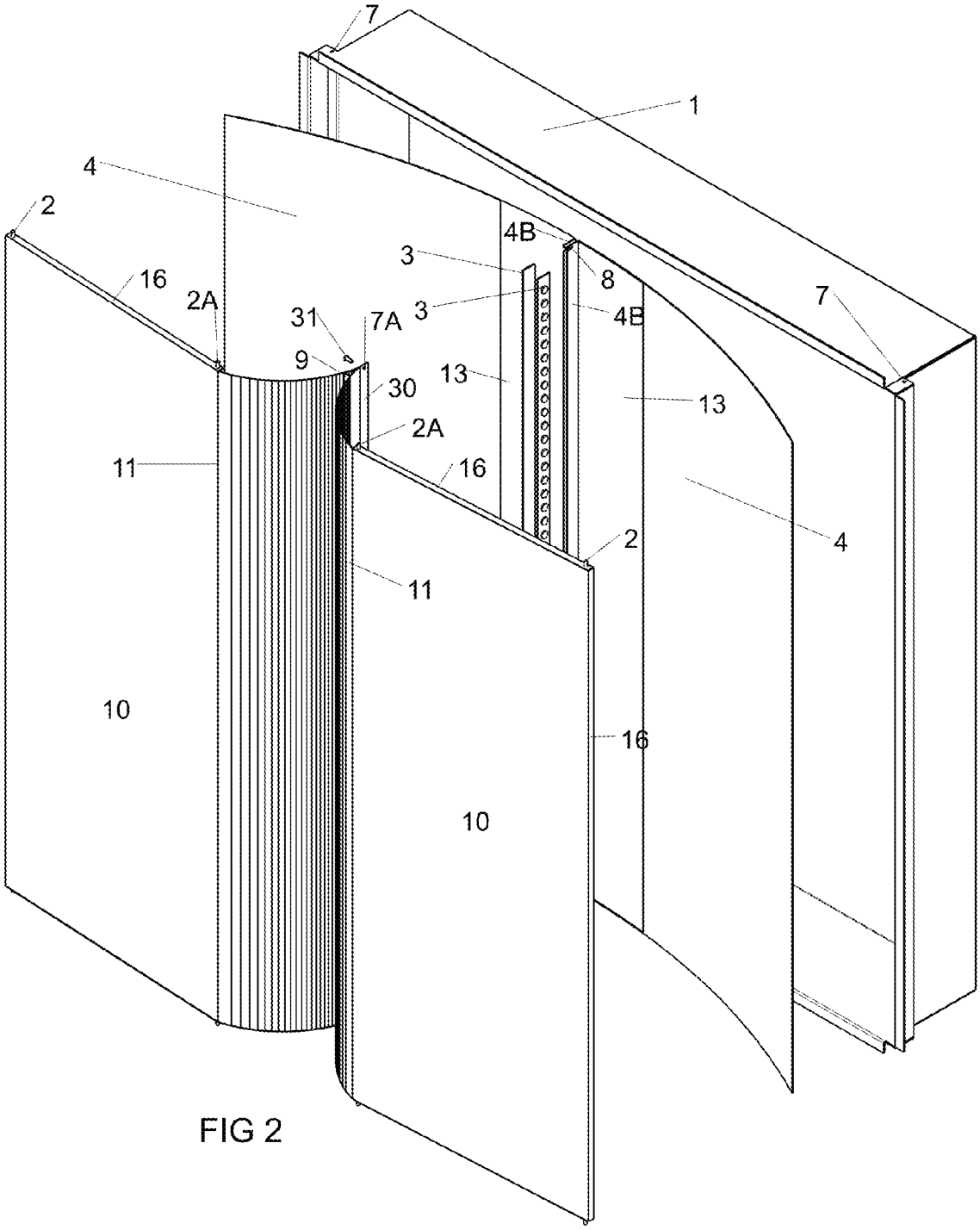
FIG. 2 depicts a perspective exploded view of an example embodiment of light fixture with an example embodiment of an optical film light modifying element.
Figure 3A:
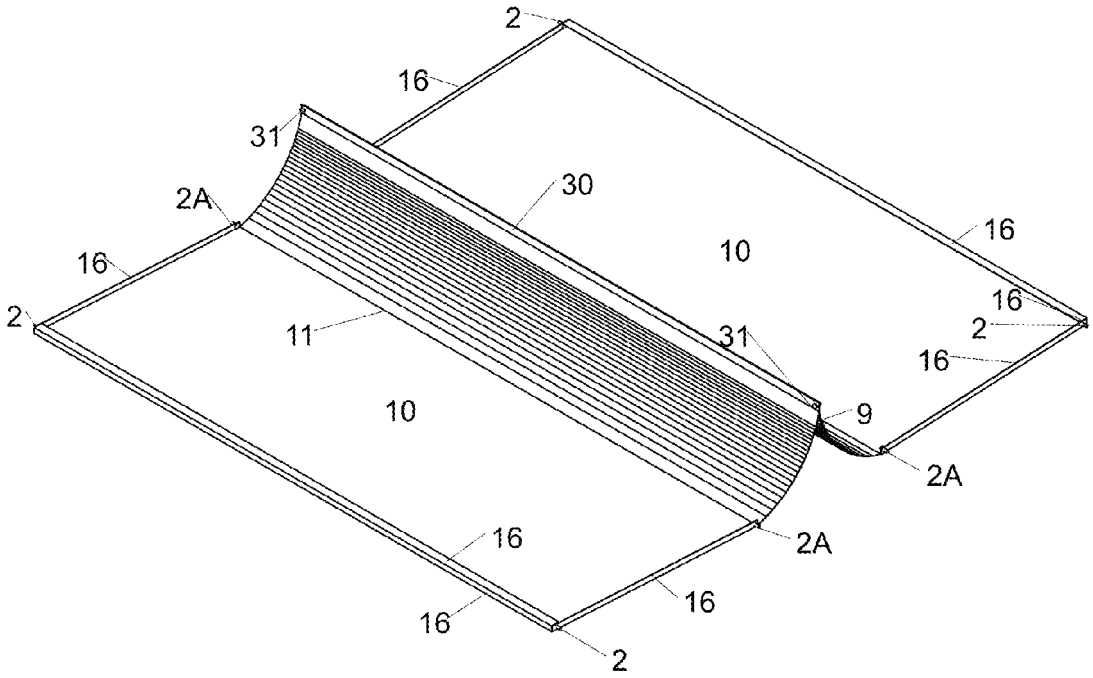
FIG. 3A depicts a bottom perspective view of an example embodiment of optical film light modifying element.
Figure 3B:
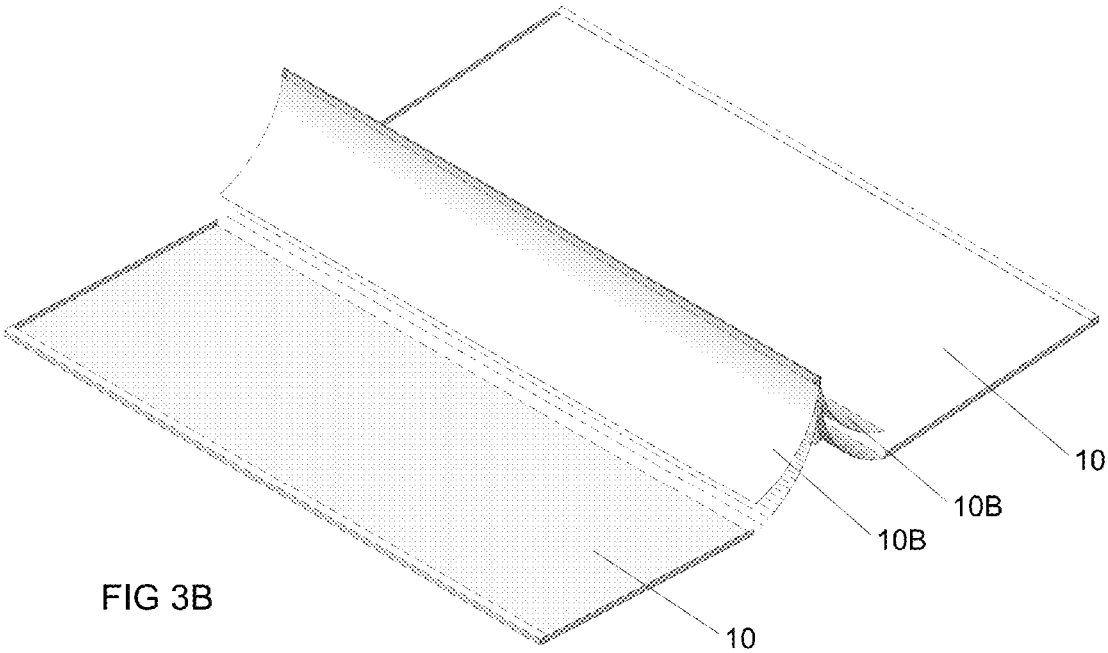
FIG. 3B depicts an exploded bottom perspective view of an example embodiment of optical film light modifying element with optical film overlays.

FIGS. 2 and 3B depicts an example implementation of the technology characterized by an optical film LME.

Referring to FIG. 3A, in certain example implementations, the LME 10 may comprise two separate pieces of optical film, or may comprise only one piece. The determination of that configuration may be based on which configuration may achieve the lowest manufacturing cost, ease of manufacture, ease of installation etc. The optical film may comprise any type of optical film that may be suitable for an intended application, and may include any types of optical film as described in the related applications, which may include diffusion films, diffusion films with light condensing properties, prismatic films, holographic films, films with micro-structured surfaces etc. According to an example implementation of the disclosed technology, the LME 10 may be configured with score lines wherein the film may be folded along score lines, creating edge trusses 16. In certain example embodiments, folds may be created along the same lines without scoring provided the means of folding can produce acceptably suitable folds. FIG. 4A depicts an example optical film cutting and scoring template for an example embodiment shown FIG. 2 and FIG. 3A. This example cutting template for the LME 10 includes fold or score lines 20, along which the optical film may be subsequently folded, refraction element score lines 11, and mounting holes 7. In accordance with an example implementation of the disclosed technology, a piece of optical film may be cut utilizing this template by methods previously described, and then folded in such a manner wherein edge trusses 16 are configured. Section 30 indicates the LME mounting section with holes 7A which may subsequently receive a fastener.

In an example embodiment as shown in FIG. 3A, an LME 10 may be configured from two pieces of optical film as described. Each LME section 10 may comprise a planar section with edge trusses 16 on each edge, and a curved section without edge trusses. The sections with edge trusses may be disposed in a substantially planar configuration after installation, while the sections without edge trusses may form a curve when compressed and mounted in an example embodiment of light fixture.

When the example embodiment of LME is folded and configured similarly to that shown in FIG. 3A, plastic push in rivets or any other suitable fastener may be installed in the mounting holes, as shown by rivets 2 and 2A. Fasteners 2A may not be required, depending on the light fixture configuration. The position and configuration of mounting features can be altered to suit the application. Alternatively, tabs may be configured in the edge trusses 16 as described in a previous related application, which may nest in slots, holes or fold etc. in the light fixture enclosure. No fasteners except for the those on the LME mounting section 30 may be required on certain example embodiments of light fixture, for example, the fixture shown in FIG. 1E that may comprise enclosure flanges 1B.

Each mounting section 30 of each LME 10 may be placed together along with an optional center trim piece 9 as previously described, and a suitable fastener such as nut and bolt set 31 may be installed through holes 7A configured in the LME mounting sections (also shown by holes 7A on FIG. 4). Referring to FIG. 2, the attached LME mounting sections 30 may be inserted in the space between the reflector panel flanges 4B, and each nut and bolt set may be inserted into mounting slots 8 (only one mounting slot 8 is visible in FIG. 8). When tightened, the nut and bolt sets 31 may function to attach the LME sections 10 to the reflector panels 4, and to squeeze the reflector panels together, securely sandwiching the length of the LME sections between the reflector panels 4.

Alternatively, a pin arrangement may be utilized as a fastener, wherein the pins may snap into a reciprocal female mounting slots on the LED array mounting features, thereby allowing the LME assembly to be easily attached and removed from the light fixture. Example embodiments of optical film LMEs may also attach to example embodiments of light fixture by any other method previous described, such as those described for LMEs comprising clear or translucent, rigid or semi-rigid substrates.

Referring to FIG. 2, once the LME mounting section 30 are installed as described, rivets 2A in edge trusses 16 may be inserted into corresponding holes in the light fixture enclosure 1. With the LME sections 10 now fastened at two attachment points, the LME sections without edge trusses may now be disposed in a curved configuration as shown. The remaining two rivets 2 on each LME section 10 (or tabs as described) may be inserted into mounting holes 7 on the fixture enclosure 1. The installed LME assembly 10 may look similar to that shown in FIG. 1A.

Refraction elements 11 may be configured onto the optical film, as shown in FIG. 2, FIG. 3A, and FIG. 4A. The refraction elements may be scored, pressed, stamped, etched or created by any suitable means which enable an acceptable visual appearance. The refraction elements may be configured on either surface of the optical film piece(s), although it may be visually preferable to configure them onto the back unstructured side of an optical film. Referring to FIG. 2, the refraction elements 11 may function to help blend and obscure the presence of the LED arrays 3, increase the perceived depth of the LME, and may create a more visually appealing look. The space between individual refraction elements 11 may be increased as the distance from the axis of symmetry of each LME section 10 increases. Since the brightness on the LMEs 10 surfaces may be higher nearest the LED arrays 3, and decrease as the distance from the LED arrays increases, the progressively increasing space between the refraction elements 11 may function to aid in visually masking this higher brightness in a visually appealing way. The refraction features may be oriented parallel to the LED arrays 3, wherein direct light from the LED arrays may strike the sides of the refraction features, which may create a more pronounced effect.

Referring to FIG. 2, optional prismatic film strips 13 may be installed as previously described.

In an example embodiment as disclosed, no doorframe may be required to support the LME, which may offer significant manufacturing cost savings. There may be many possible methods of attachment of example embodiments of the disclosed technology to any given light fixture, as well as LME dimensions and configurations that may vary depending on the light fixture configuration, the intended application etc. Although a particular method of attachment and general LME size and edge truss configuration has been described with respect to a particular light fixture, this should not in any way limit the general scope of example embodiments.

Example embodiments of optical film LMEs may be attached to light fixtures with magnets, hook and loop fasteners, adhesives, clips, extrusions, springs, or any other method which may be suitable for the application. Protuberances such as rivets, clips etc. may be installed on edge trusses of example embodiments wherein the protuberances may attach to corresponding areas of a light fixture, securing an example embodiment to a light fixture. Example embodiments of LMEs may also mount in a light fixture doorframe without any fasteners. Example embodiments of optical film LMEs may nest in a channels formed into a light fixture enclosure. In example embodiments of optical film LMEs, once the LMEs are attached to the LED mounting flanges, the LMEs may subsequently be laterally compressed, and the LME edges may be inserted under two enclosure lip flanges 1B as shown in FIG. 1E, wherein the LMEs attachment to the LED mounting flanges 4B, the enclosure lip flanges 1B, and the side edges of the enclosure 1 may function to retain the LMEs 10 in a compressed state.

In example implementations, the LME(s) may be comprised of diffusion film with light condensing properties as previously described in related applications, or comprised of any kind of light condensing film. Generally, light condensing optical film may direct a portion of light refracting through it more towards the direction of the normal of its surface. Because of this, a greater portion of refracted light may be directed outwards towards the direction of the surface normals than would have otherwise if the LME were comprised of non-light condensing optical film. Accordingly, in the example embodiment of LME as shown in FIG. 1A for example, on the curved sections of LME 10, less light may be directed in a forward direction (perpendicular to the plane of the light fixture aperture) than would be if the example embodiment of LME did not have light condensing properties, which may function to lower the overall brightness of the problem area. The flat sections of the LME 10 may also direct a portion of light refracting through it more towards the direction of the normal of its surface, which may function to narrow the width of the light distribution of the light fixture.

Figure 3C:
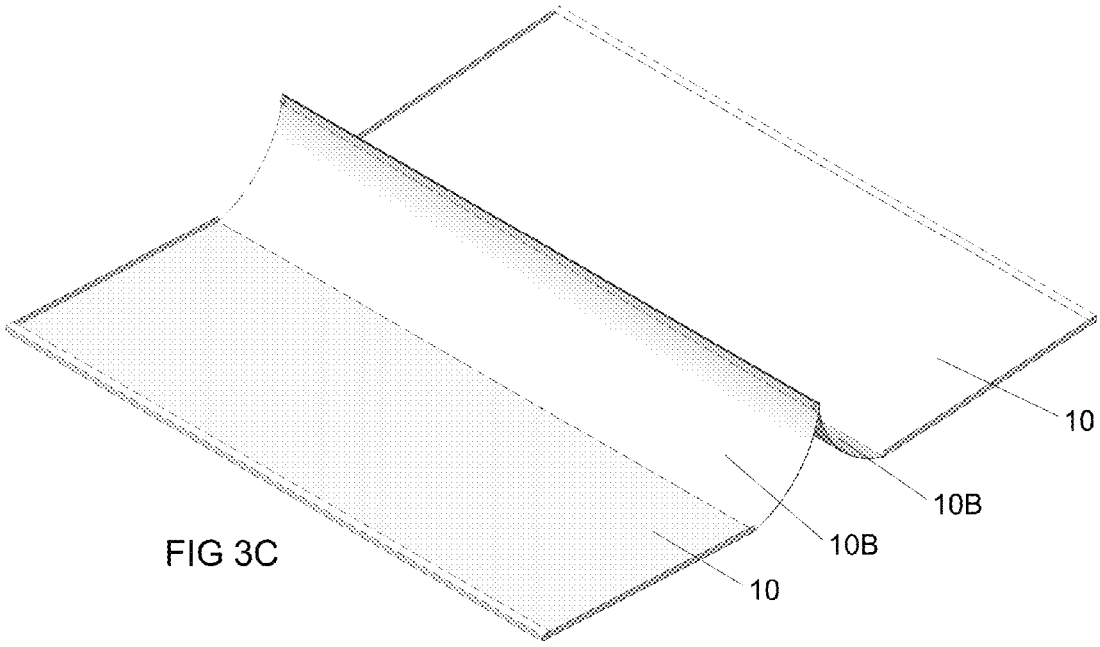
FIG. 3C depicts a bottom perspective view of an example embodiment of optical film light modifying element with optical film overlays.

Referring to FIGS. 3B and 3C, in an example embodiment of LME, an additional layer of optical film 10B may nest beneath the LMEs 10. FIG. 3B shows an upside down exploded perspective view, and FIG. 3C shows a non-exploded view. Additional optical film layer 10B may nest beneath the curved sections of the LMEs 10, and the additional optical film layers 10B may be configured and fastened in a similar way as the LMEs 10. The addition film layers may function to add greater diffusion and lamp hiding in the problem area, and may also function to create greater visual definition and appeal to the curved sections of the LME.

The example implementation as shown in FIG. 1A may show the planar surfaces of the LME 10 sloping away from the fixture's aperture plane as the distance towards the left and right edges of the light fixture enclosure 1 increases. However, whether comprised of optical film or a clear or a substrate as described, example implementations may also be configured with horizontal, non-sloping planar sections as shown in FIG. 1F.

Figure 4C:
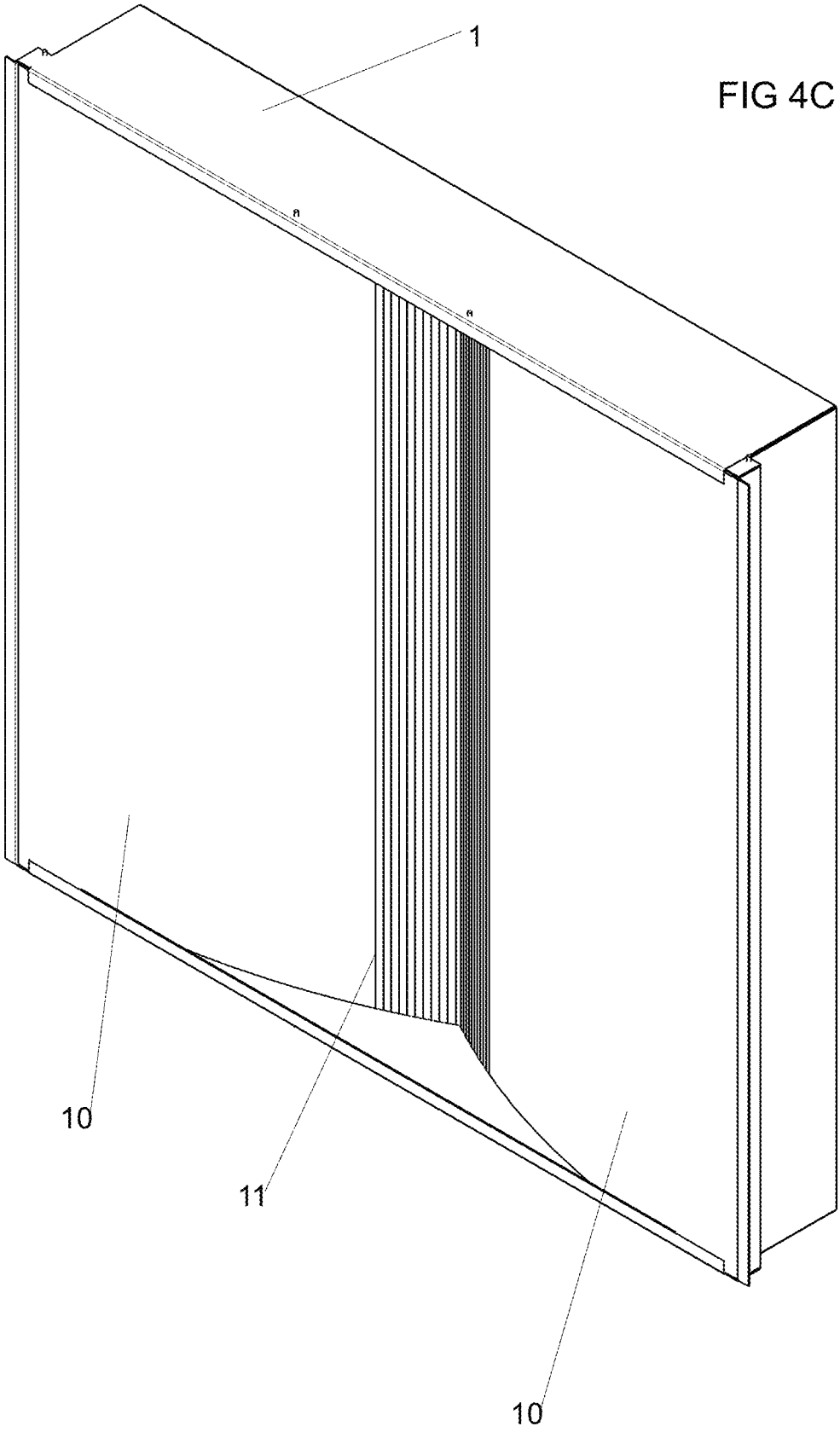
FIG. 4C depicts a perspective view of an example embodiment of light fixture with a curved light modifying element.

Example embodiments of LME and example embodiments of light fixtures with LMEs that comprise a curved section and a planar section as described may also comprise LMEs that have much larger curved section and smaller or non-existent planar sections as shown in FIG. 4C. LME sections 10 with linear refraction features 11 form a long arcing profile with a minimal planar section where the LME sections contact the flange on light fixture enclosure 1.

Figure 5A:
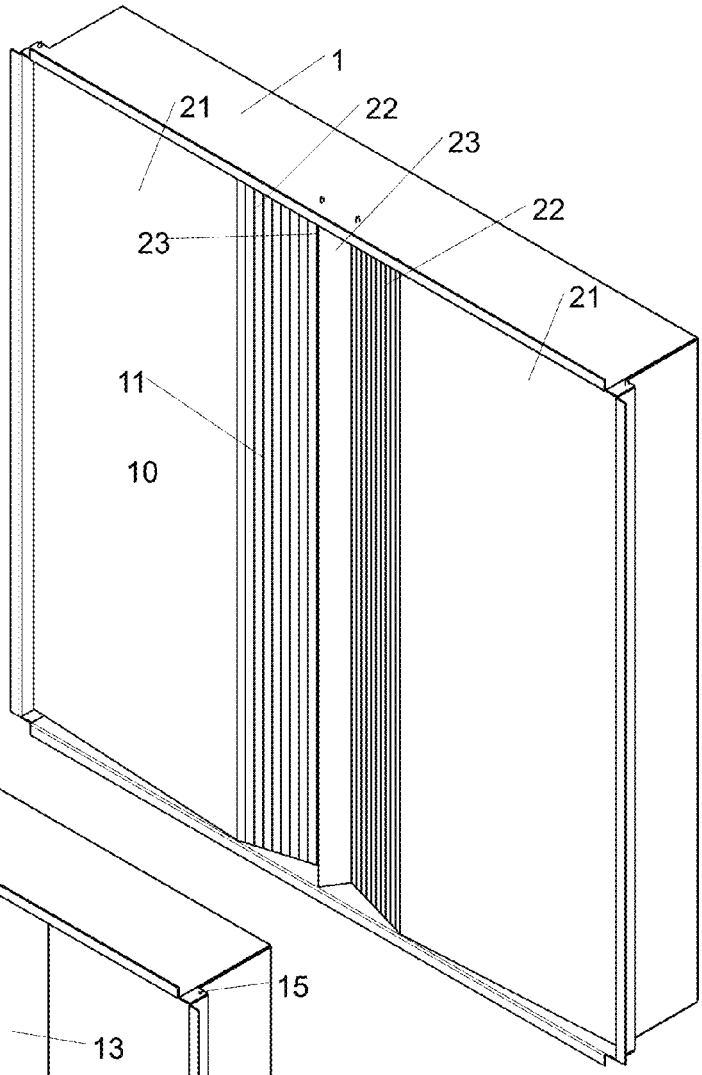
FIG. 5A depicts a perspective view of an example embodiment of light fixture and multi-plane light modifying element.
Figure 5B:
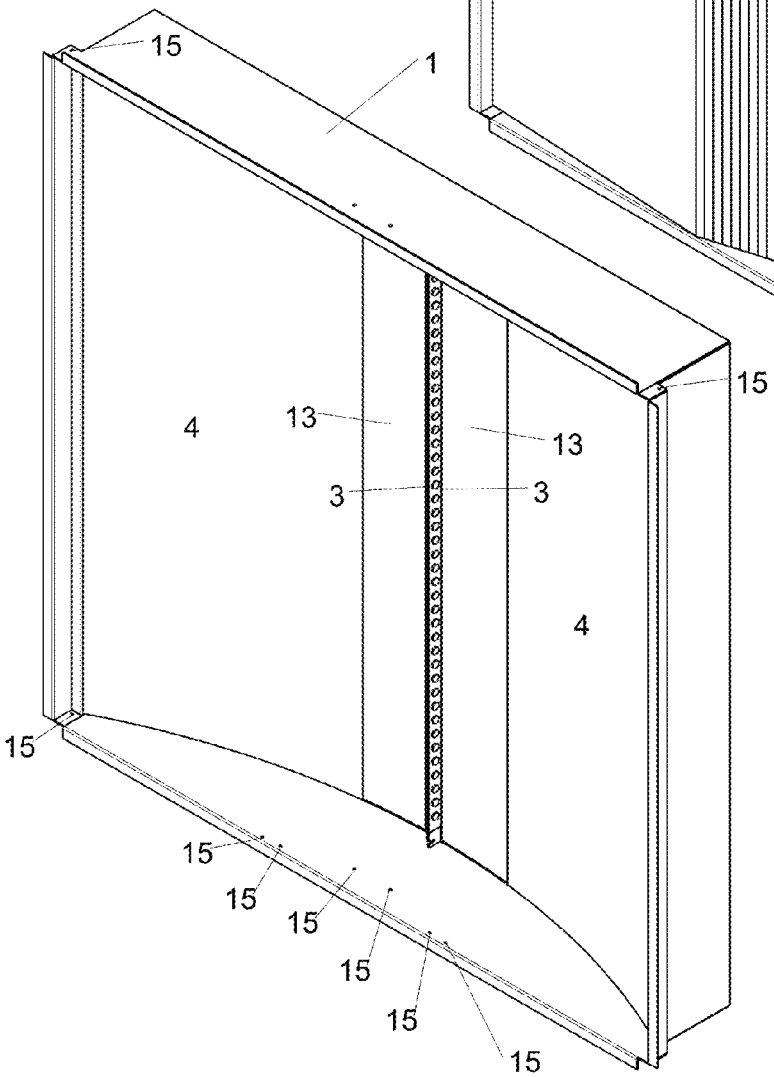
FIG. 5B depicts a perspective view of the example embodiment of light fixture and light modifying element depicted in FIG. 5A but with the light modifying element removed.

FIG. 5A depicts a perspective view of an example implementation of the disclosed technology of light fixture and multi-plane light modifying element, and FIG. 5B depicts the same view, but with the LME 10 removed. In an example implementation, the advantages of good lamp hiding, wide and even light distribution, along with excellent luminaire efficiency may be realized utilizing only two LED arrays 3 as an illumination source. Although higher diffusion material may be utilized with good results, for illustrative purposes in the following descriptions of example embodiments, it will be assumed that a major design goal will be to maximize luminaire efficiency. Accordingly, it may be preferable to utilize a diffusion material with lower diffusion properties and higher light transmission levels, combined with light condensing properties. The following descriptions of example embodiments may be assumed to be utilizing diffusion material with low diffusion properties and high light transmission levels combined with some light condensing properties.

In an example implementation, the light fixture without the LME attached as shown in FIG. 5B may be similar or identical to the light fixture as shown and described in FIG. 1B, and may include the light fixture enclosure 1, reflector panels 4, LED arrays 3, optional prism film strips 13, and lens mounting holes 15, and will not be described again for brevity. Any example embodiments of reflectors or LED array mounting features previously described may be utilized.

Referring to FIG. 5A, LME 10 may comprise a single structure. The LME 10 may comprise a clear or translucent substrate configured to modify light from a linear LED array. The LME 10 may include lens planes 21, 22 and 23 as indicated. The substrate may include any type of substrate that may provide suitable structure and optical properties for the intended application. Examples of suitable substrates may include polycarbonates, acrylics, optical film etc. The substrate may have associated with it any type of light modifying features that may be suitable for an intended application. In one example implementation, the substrate may have a light modifying layer deposited on either or both surfaces. For example, in one embodiment, the light modifying layer(s)

may include diffusion particles such as glass beads. In other example implementations, the substrate may have light modifying elements incorporated within the substrate itself, such as diffusion particles for example. In certain example implementations, the substrate may have features formed onto its outer surface, such as prismatic features. In accordance with various example implementations of the disclosed technology, the substrate may have various combinations of light modifying features, for example, particles incorporated into the substrate itself and a light modifying layer deposited on one or more surfaces. In an example embodiment, the LME may be fabricated by any suitable method, such as injection molding, vacuum forming or extrusion methods for example.

Figure 8:
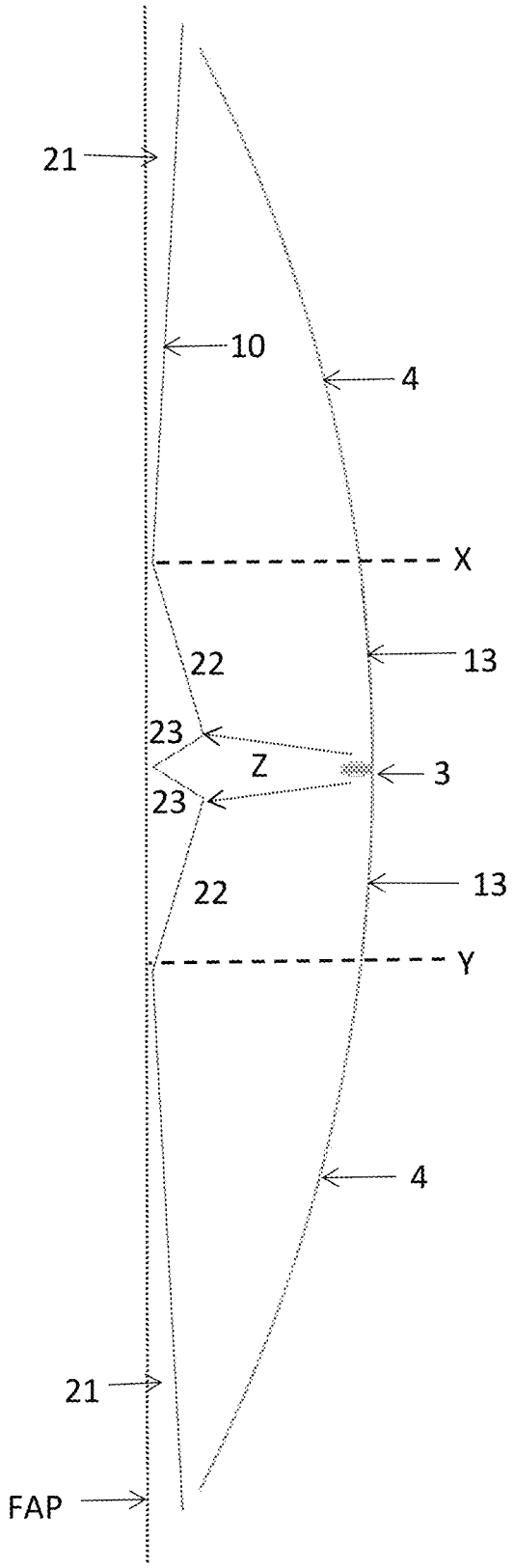
FIG. 8 depicts a diagram of light propagation within the example embodiment of light fixture and light modifying element depicted in FIGS. 5A and 5B.

FIG. 8 may show a simplified side cross section view of an example embodiment of light fixture and multi-plane LME 10 similar to that shown in FIG. 5A, and may include reflector panels 4, optional prismatic film strips 13, and LED arrays 3. Certain functional aspects of the LME may be similar to that as described in FIG. 4B, and may not be repeated for brevity. The LME may include lens planes 21, 22 and 23.

At lamp to lens depths of 3" to 3½" as may be typical of commercially available troffer light fixtures, if a flat diffusion lens utilizing the same low diffusion material were used, high pixelization may occur in the vicinity of the LEDs from various viewing angles, the problem area between the lines X and Y may be objectionably bright, and the dead zone directly above the two LED arrays may be visibly objectionable.

The light reflection, refraction and TIR principles of diffusion materials previously described, along with the optical properties of bi planar lenses described in a related application may be utilized to help correct the problems as described. Again referring to FIG. 8, zone Z between the two arrows may indicate the area on the lens that may include a shadow caused by the dead zone (the area between the two back to back LED arrays 3), as well as a high brightness area from direct light from the LED arrays 3. Lens planes 23 may form a bi-planar lens across zone Z, which may create a discrete visual partition of a homogenous blend of the dead zone shadow along with the immediately adjacent high brightness. This may function to almost completely mask the appearance of the dead zone and create a pleasing visual aesthetic. The apex of lens planes 23 may preferably be disposed at the greatest distance from LED arrays 3 as the light fixture will allow, as increased distance may increase the effect as described.

Lens planes 22 may form an inverted bi-planar lens. With the appropriate diffusion material with light condensing properties, and the appropriate angles of lens planes 22 relative to the light fixture aperture plane as indicated by the dotted line FAP, pixelization may be eliminated, and the light intensity in the problem area between lines X and Y may be significantly reduced. The chosen angles of lens planes 22 may need consideration however. As their angles relative to the line FAP are increased, forward brightness may be decreased. However, assuming the intersection points between lens planes 21 and 22 remain fixed, the distance of lens planes 22 to the LED arrays 3 may be simultaneously decreased. Pixelization may be evident if the angles of lens planes 22 are increased too much. Accordingly, a harmonious balance may need to be obtained, perhaps through trial and error. Lens planes 22 may function to create a discrete visual partition of homogenous brightness, which may be visually appealing. In summary, lens planes 22 and 23 may function to turn the disadvantages of the problem area and the dead zone as described into visually striking LME features. In other words, turning that frown upside down ☺.

Prism film strips 13 may be optionally utilized to lower brightness in the problem area as previously described. However, due to low diffusion materials utilized in the LME, unwanted specular reflections on the reflector panels 4 may occur. The size and placement of the prism film strips may need to be modified if said reflections occur, or the prism strips may need to be eliminated altogether.

Angled lens planes 21 may function as previously described, and may have sufficient distance from the LED arrays 3 to achieve acceptably even illumination and no pixelization. In alternate example embodiments, the lens planes 21 may be substantially parallel to line FAP. Luminaire efficiency may decrease somewhat compared to angled lens planes 21 as described.

Another feature of an example embodiment is shown in FIG. 5A. The lens planes 22 of LME 10 include linear refraction features 11. The refraction features 11 may function to blend and obscure the presence of the LED arrays 3 in the problem area, which may create a more visually appealing look. The space between individual refraction elements 11 may be increased as the distance from the lens planes 23 increases. Since the brightness on the LME 10 surface may be higher nearest the lens planes 23, and decrease as the distance from the lens planes 23 increases, the progressively increasing space between the refraction features 11 may function to aid in visually masking this higher brightness, and may function to give more visual depth to lens planes 22. The refraction features 11 may be formed utilizing any methods previously described. For example, the refraction elements 11 may be configured into the LME 10 during manufacturing, and may be formed as linear protuberances or groves in either side of the substrate, lines etched into either side of the substrate, or formed by any other method that may achieve acceptable visual results. The refraction features 11 may be oriented parallel to the LED arrays 3, wherein direct light from the LED arrays may strike the sides of the refraction features, which may create a more pronounced effect.

Figure 7A:
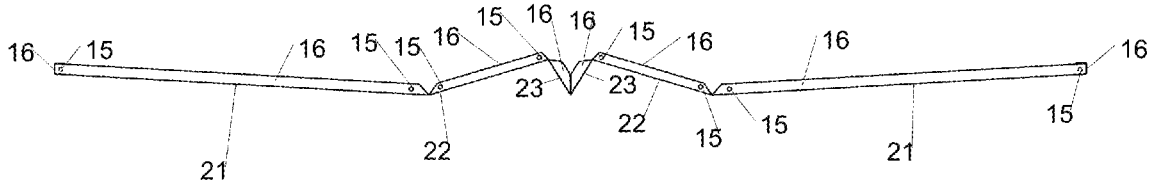
FIG. 7A depicts a side profile view of an example embodiment of optical film light modifying element.
Figure 7B:
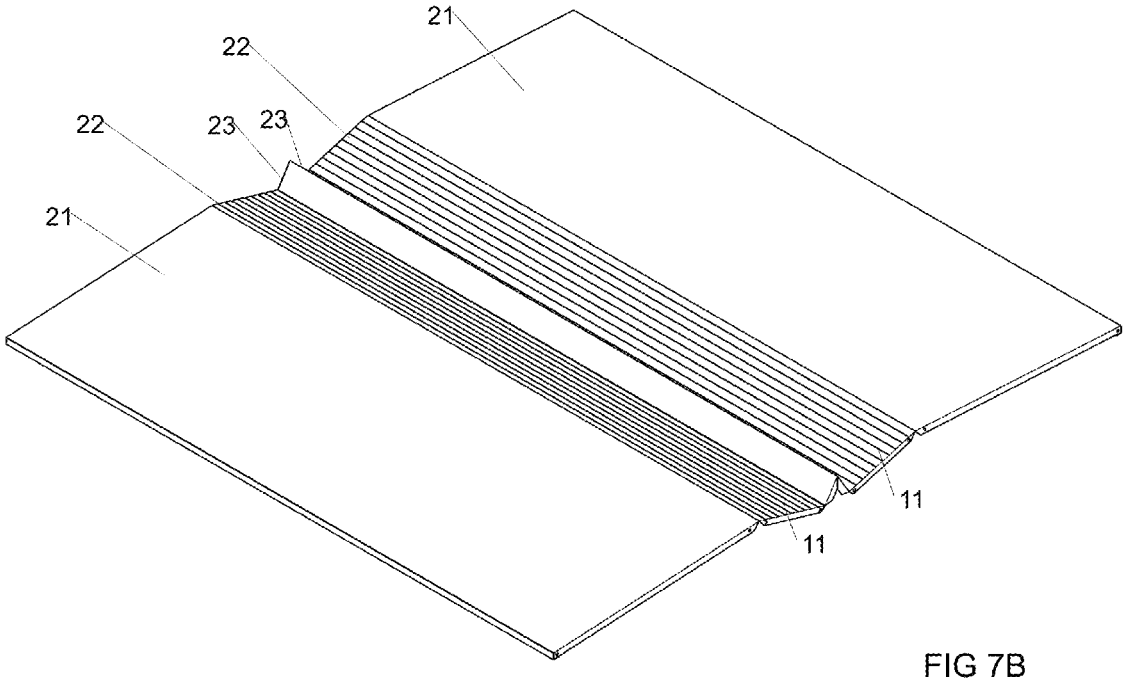
FIG. 7B depicts a top perspective view of the example embodiment of the optical film light modifying element depicted in FIG. 7A.
Figure 9:
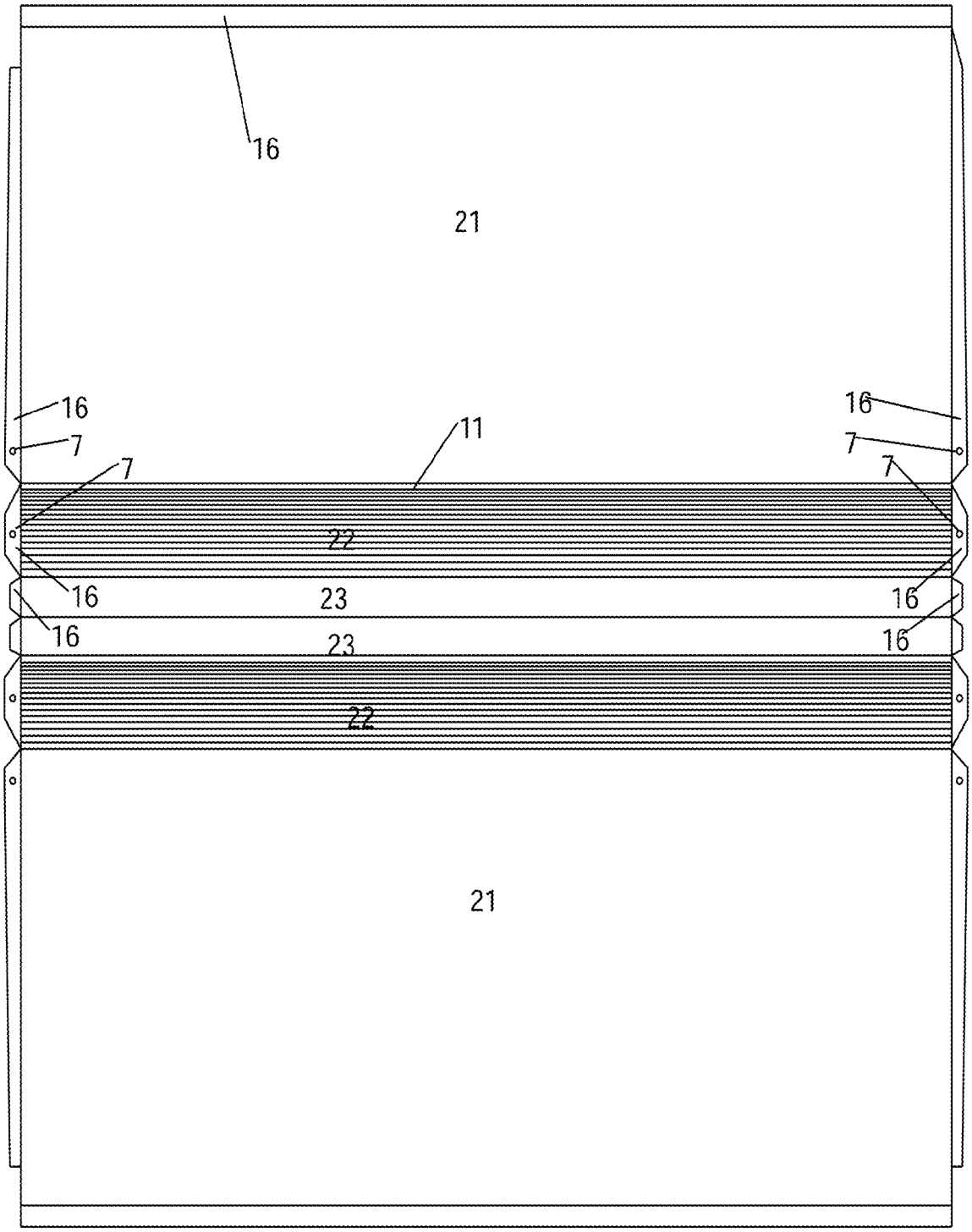
FIG. 9 depicts an optical film cutting and scoring template for the example embodiment of light modifying element depicted in FIG. 7B.

Referring to FIG. 7A and FIG. 7B, in certain example implementations, the LME may comprise a single piece of optical film. The optical film may comprise any type of optical film as previously described. According to an example implementation of the disclosed technology, the LME may be configured as previously described with score lines wherein the film may be folded along score lines, creating edge trusses 16. FIG. 9 may depict an example optical film cutting and scoring template for an example embodiment shown in FIGS. 7A and 7B, and may include lens planes 21, 22 and 23. This example cutting template may include fold or score lines, along which the optical film may be subsequently folded. In accordance with an example implementation of the disclosed technology, a piece of optical film may be cut utilizing this template by methods previously described, and then folded in such a manner wherein the edge trusses 16 are configured. The LME cutting template may be configured with mounting holes 7, edge truss sections 16, and linear refraction elements 11.

Figure 6:
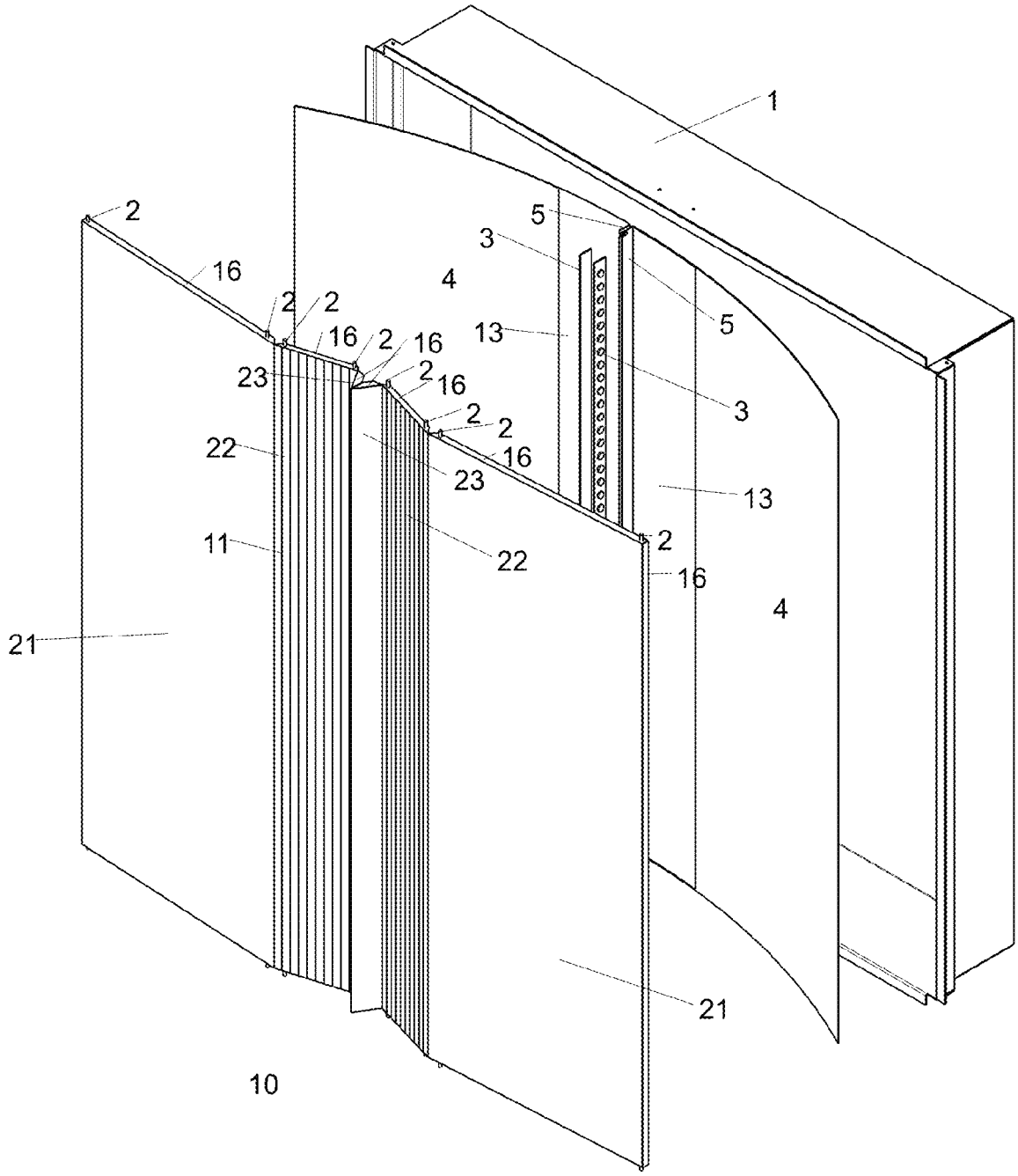
FIG. 6 depicts a perspective exploded view of an example embodiment of the light fixture and optical film light modifying element depicted in FIGS. 5A and 5B.

Similar to previous example embodiments of optical film LMEs, linear refraction features 11 as shown in FIG. 6, FIG. 7B, and FIG. 9 may be configured onto the optical film.

Referring to FIG. 7A that may show a side profile view, and FIG. 7B that may show a top perspective view of an example embodiment of optical film multi-plane LME, mounting holes 15 may be configured in the edge trusses 16, wherein plastic push in rivets or any other suitable fastener may be installed therein. Lens planes 21, 22 and 23 are indicated.

In an example implementation, the light fixture without the LME attached as shown in FIG. 6 may be similar or identical to the light fixture as shown and described in FIG. 1B and FIG. 5B, and may include the light fixture enclosure 1, reflector panels 4, LED arrays 3, and optional prism film strips 13, and will not be described again for brevity. Any example embodiments of reflectors or LED array mounting features previously described may be utilized.

Referring to FIG. 6, and once the plastic rivets 2 or other fasteners as described have been installed in the LME 10, rivets 2 may be inserted into corresponding holes in the light fixture as shown by holes 15 in FIG. 5B. The installed LME assembly 10 may look similar to that shown in FIG. 5A.

In an example embodiment as disclosed, no doorframe may be required to support the LME, which may offer significant manufacturing cost savings. There may be many possible methods of attachment of example embodiments of the disclosed technology to any given light fixture, as well as LME dimensions and configurations which may vary depending on the light fixture configuration, the intended application etc. Although a particular method of attachment and general LME size and edge truss configuration has been described with respect to a particular light fixture, this should not in any way limit the general scope of example embodiments. For example, example embodiments of LME may be attached to doorframes. Example embodiments of LME may nest in a doorframe. Example embodiments of LME may nest in a channels formed into a light fixture enclosure.

Example embodiments of the disclosed technology may be attached to light fixtures or light fixture doorframes with magnets, hook and loop fasteners, adhesives, clips, extrusions, springs, or any other method that may be suitable for the application. Protuberances such as rivets, clips etc. may be installed on edge trusses of example embodiments wherein the protuberances may attach to corresponding areas of a light fixture, securing an example embodiment to a light fixture. Example embodiments of lenses may also mount in a light fixture doorframe without any fasteners.

Referring to FIG. 7A, in an example embodiment of LME, edge trusses 16 may be eliminated on lens planes 22. Lens planes 22 may subsequently form a curve when the LME is installed, which may also be visually pleasing.

Certain example embodiments of lenses described in this patent application may have been described being associated with, or utilized in conjunction with certain example embodiments of light fixture. This should not however, limit the scope of possible applications that example embodiments of lenses may be used in. Example embodiments of lenses described herein may be utilized with any suitable configuration of light fixture or light emitting device.

When linear LED arrays are used as a light source for a light fixture such as a troffer as previously described, and the LED arrays are mounted on the back surface of the fixture facing the lens, the pinpoint high intensity light from the LEDs may create a significant problem with respect to having excessively bright strips in the vicinity of the LED arrays, and uneven or visually unpleasing light distribution within the light fixture and across the lens. Typically in such a configuration that may utilize a high diffusion flat lens, although pixilation may be eliminated, the lens may still exhibit a bright, relatively thin strip above where the LED arrays are located, and relatively uneven light distribution within the fixture and across the lens. This may create visually unpleasing shadows, especially when viewed from off-axis. This may create an unimpressive and cheap visual impression to viewers. Some or all of these problems may be addressed by example embodiments that may herein be described.

Figures 12A, 12B:
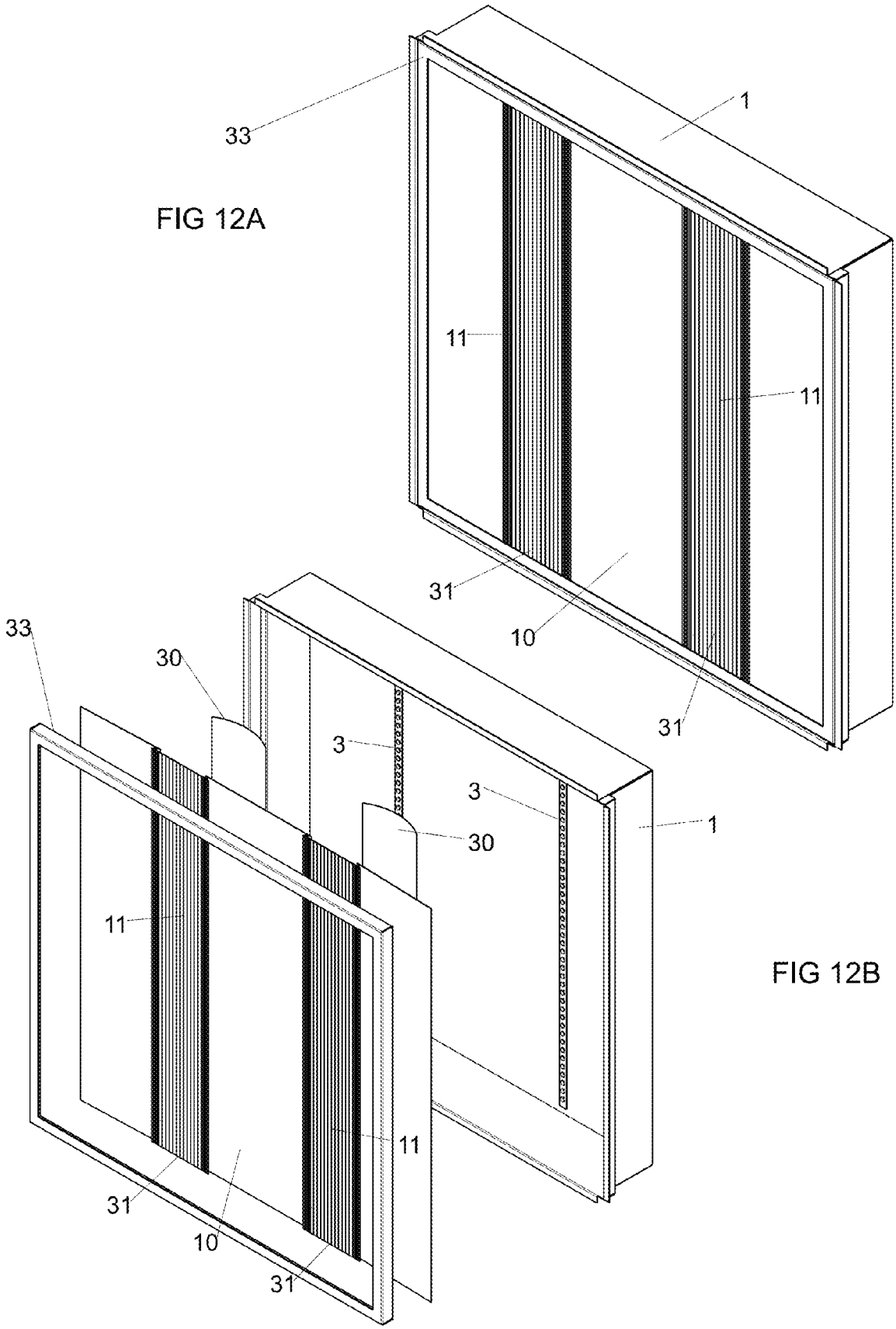
FIG. 12A shows a perspective view of an example embodiment of light fixture with multi-plane light modifying element and optical film inserts.
FIG. 12B shows an exploded perspective view of the example embodiment of light fixture with multi-plane light modifying element and optical film inserts as shown in FIG. 12A.

An example embodiment of multi-plane LME with optical film inserts may be shown in FIGS. 12A and 12B. The LME 10 may be mounted inside a doorframe 33, wherein the doorframe may be mounted on a light fixture enclosure 1, with two linear LED arrays 3 mounted on the inside back surface of the enclosure 1. The LME 10 may comprise a clear or translucent substrate configured to modify light from the LED arrays 3. The substrate may include any type of substrate as described in previous example embodiments, and may be fabricated by methods previously described.

In an example embodiment, the LME 10 may include two raised sections 31, wherein the raised sections 31 may each be substantially centered over LED arrays 3. Referring to FIG. 13B that may show a side profile view of an example embodiment, the LME 10 may have two raised sections 31 with sides 30B which may form an acute angle relative to the plane defined by the surface of the raised section 31, which may create slots 34. Flat strips of optical film 30 may be configured of an appropriate dimension greater than the width of the raised sections 31 such that when the two opposing major edges are squeezed together and inserted into opposing slots 34, the optical film strips 30 may form a curved shape as shown. The structured surface of the optical film insert 35 is shown facing the LME raised sections 31. The optical film strips 30 may comprise any optical film which may have suitable optical characteristics for an intended application. Two examples may now be described.

The optical filmstrips 30 may comprise prismatic optical film. The structured surface of the prismatic film may preferably be oriented with its structured surface 35 (FIG. 13B) facing the LME raised sections 31. Light reflecting and refracting properties of prismatic film are well understood to those skilled in the art, and will not be further discussed herein. When light from a light source such as LED arrays 3 in FIG. 12B is incident on the back surface of prismatic strips 30, up to 50% or more light may be reflected backwards "recycled". Due to the curved shape of the prismatic strips 30, light may be recycled in a direction backwards, and laterally outwards relative to the surface plane of the raised section. The degree of lateral spread may be increased by configuring the prismatic strips 30 with the prism row features oriented perpendicular to the major axis of the LED arrays 3. The prism row features may be oriented parallel to the major axis of the LED arrays 3 as well; however, the degree of lateral light spreading may be decreased.

When an example embodiment is configured as shown in FIG. 12A and FIG. 12B with prismatic strips 30, light from the LED arrays may be more evenly distributed within the fixture and across the lens as described. Additionally, light refracting through the prismatic strips 30, may be create a relatively even illumination on the LME raised sections 31, and may create a "picture box" effect. The zone of higher brightness from the LED arrays 3 may be relatively confined to the discrete area of the LME raised sections 31, and the rest of the LME 10 surface may comprise a discrete area of relatively even but lower brightness. In an example embodiment as shown, the raised LME sections may be approximately 3"-4" wide for example, which may give the appearance of 3"-4" wide light sources. Due to the light condensing properties of the prismatic strips 30, the viewing angle of light refracting through the prismatic strips 30 and raised sections 31 may be condensed. When viewed steeply off axis, the raised sections 31 may appear darker than the rest of the lens surface, which may create an "inverse" picture box effect. The overall appearance of the LME may be quite visually soft and pleasing.

The degree of curvature of an optical film strip may be adjusted to optimize light reflection and refraction distribution to suit a given light fixture configuration. Generally, a relatively shallow curve as shown in FIG. 13B may be advantageous. In an example embodiment, the optical film strips may be configured to the same approximate dimensions as the distance between two opposing slots 34 (FIG. 13B), wherein the optical film strip 30 may be disposed in a planar configuration. Although there may be less light distribution within the light fixture, it may nevertheless have a pleasing visual appeal.

In example embodiment as shown in FIGS. 12A, FIG. 12B, 13A, and 13B another example of optical film inserts may be diffusion film. Diffusion film of any kind may be utilized with the structured surface 35 facing the raised sections 31 as shown in FIG. 13B. Diffusion film with light condensing properties may achieve very good optical results, but due to the lesser degree of light recycling than prismatic film, the light may be distributed within the fixture and across the LME 10 to a lesser degree. However, luminaire efficiency may also increase as a result if relatively low diffusion film is utilized. The picture box effect may still be very good.

In an example embodiment, an important visual element may be refraction elements 11 as shown in FIGS. 12A, 12B and 13A. They may be created in a similar manner to those previously described. Referring to FIG. 13A, refraction features may be arranged in three sections on each LME raised section 31: more densely configured refraction features in sections 37, and wider spaced refraction features in section 38. Slots 34 (FIG. 13B) may create distinct shadows on the raised sections 31 caused by light from an opposing LED array striking the slot 34. As the diffusion level of an example embodiment of LME is lowered, the darker and more pronounced the shadow may become. Referring to FIG. 13A, the more densely configured refraction feature sections 37 on each side of the raised sections 31 may effectively mask any shadows as described. Refraction features in the section 38 may function to increase apparent illumination uniformity of those sections.

Figure 14A:
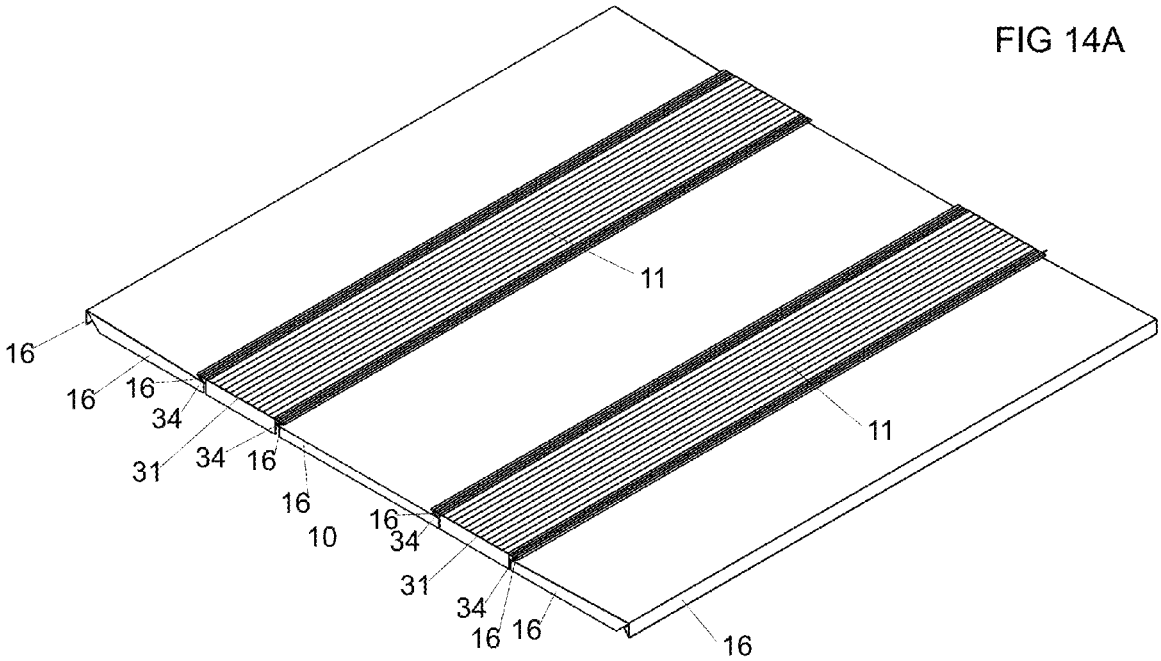
FIG. 14A shows a top perspective view of an example embodiment of optical film multi-plane light modifying element and optical film inserts.
Figure 14B:
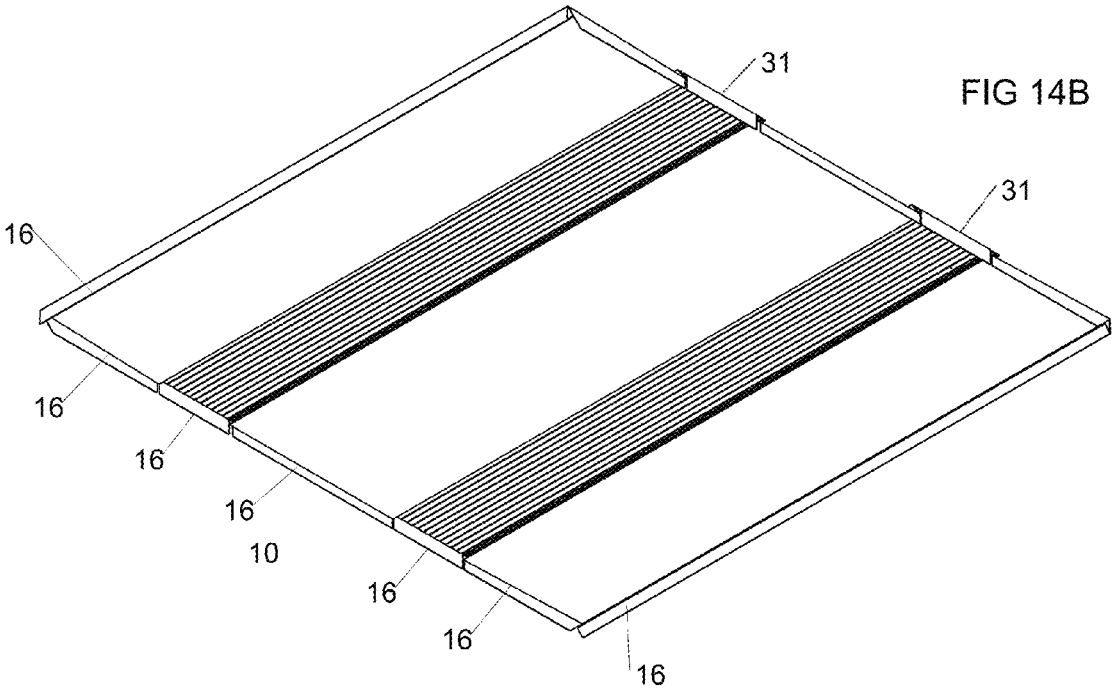
FIG. 14B shows a bottom perspective view of the example embodiment of optical film multi-plane light modifying element and optical film inserts as shown in FIG. 14A, but without the optical film inserts installed.
Figure 15:
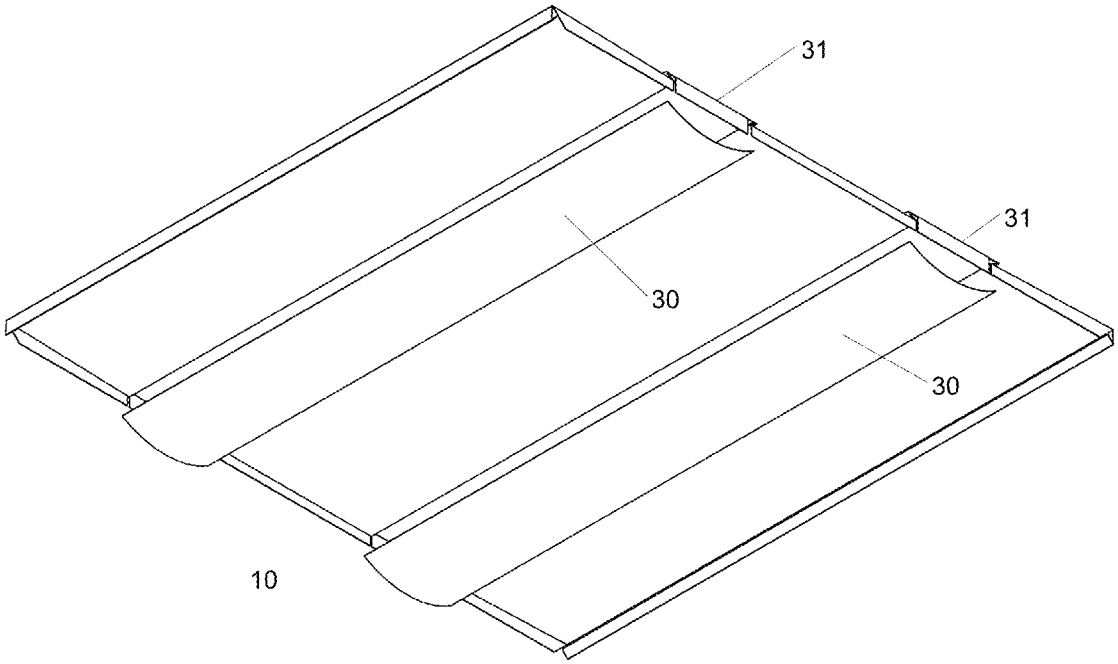
FIG. 15 shows a bottom exploded perspective view of the example embodiment of optical film multi-plane light modifying element and optical film inserts as shown in FIG. 14A.

FIG. 14A show a top perspective view, and FIG. 14B show an underneath perspective view of an example embodiment of optical film multi-plane LME with optical films inserts, similar to that as shown in FIGS. 12A and 12B. The LME 10 may utilize a single piece of optical film (any type of optical film described in previous example embodiments), and may be configured in a similar manner to previously described example embodiments of optical film LMEs, the details of which may not be repeated here. Edge trusses 16, raised sections 31, refraction elements 11, and slots 34 are all indicated. FIG. 15 shows an underneath perspective view of the same example embodiment, indicating optical film inserts 30 and raised sections 31. The LME 10 may be mounted in a doorframe of a light fixture, or may be attached to a light fixture in any other fashion as previously described. The optical film inserts 30 may be configured, installed, and function as previously described. Refraction elements 11 may be configured in a manner similar as described in the previous example embodiment shown in FIG. 13A.

Figure 16:
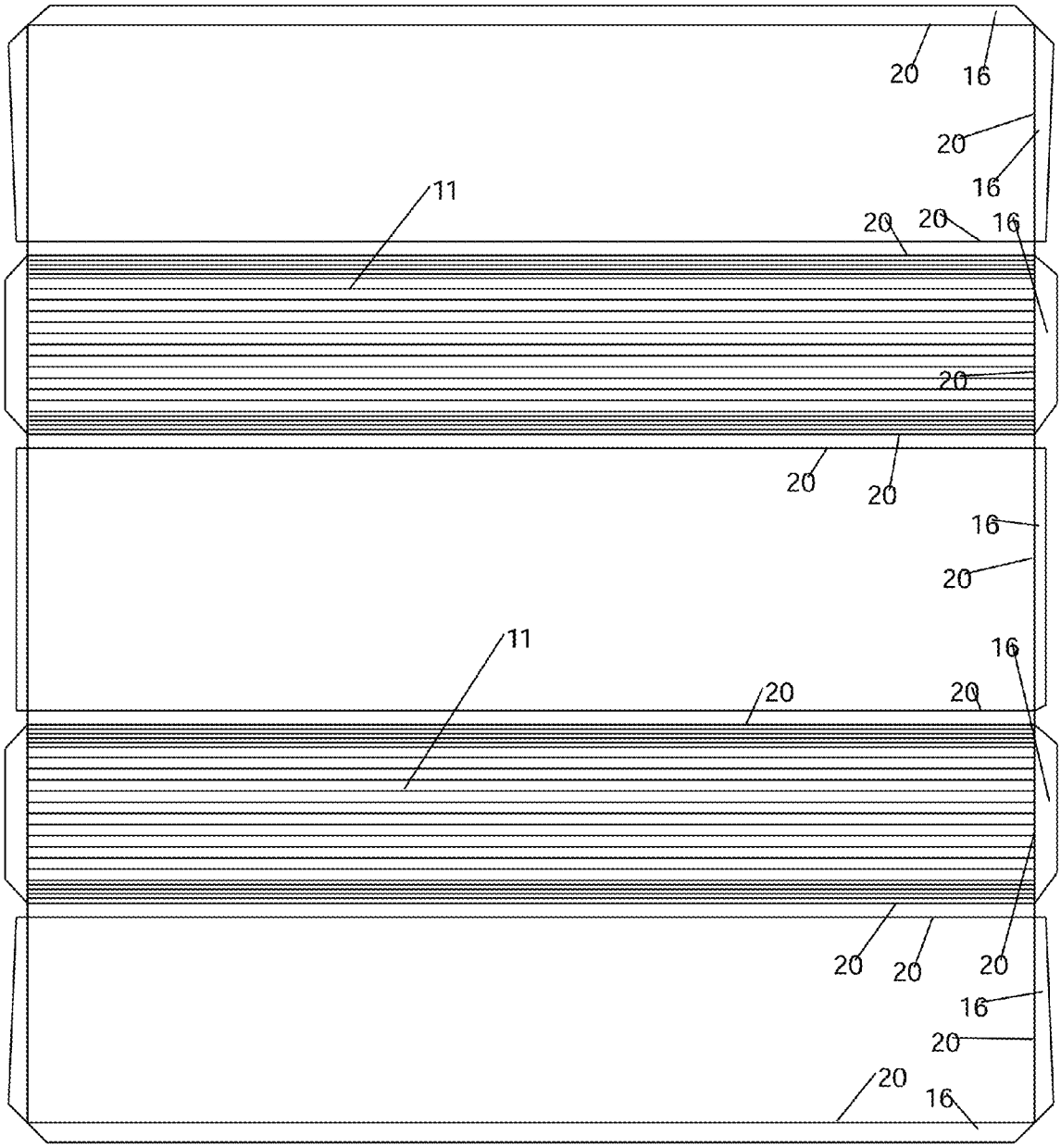
FIG. 16 shows an optical film cutting and scoring template for the example embodiment of optical film multi-plane light modifying element and optical film inserts as shown in FIG. 14A.

An optical film scoring and cutting template for the example embodiment shown in FIGS. 14A and 14B may be shown in FIG. 16, which includes linear refraction features 11, score lines 20 and edge truss sections 16.

Example embodiments of LME that include raised sections as described may also be used without an optical film strip. The degree of uniformity of illumination in the LME raised sections as well as inside the light fixture interior may be lower; however, the overall visual results may be acceptable for many applications. Luminaire efficiency may increase as a result, and manufacturing costs may be lower. A degree of the picture box effect as described may still be evident, and if linear refraction features are included, this may increase the apparent illumination uniformity of the raised sections.

Figure 17:
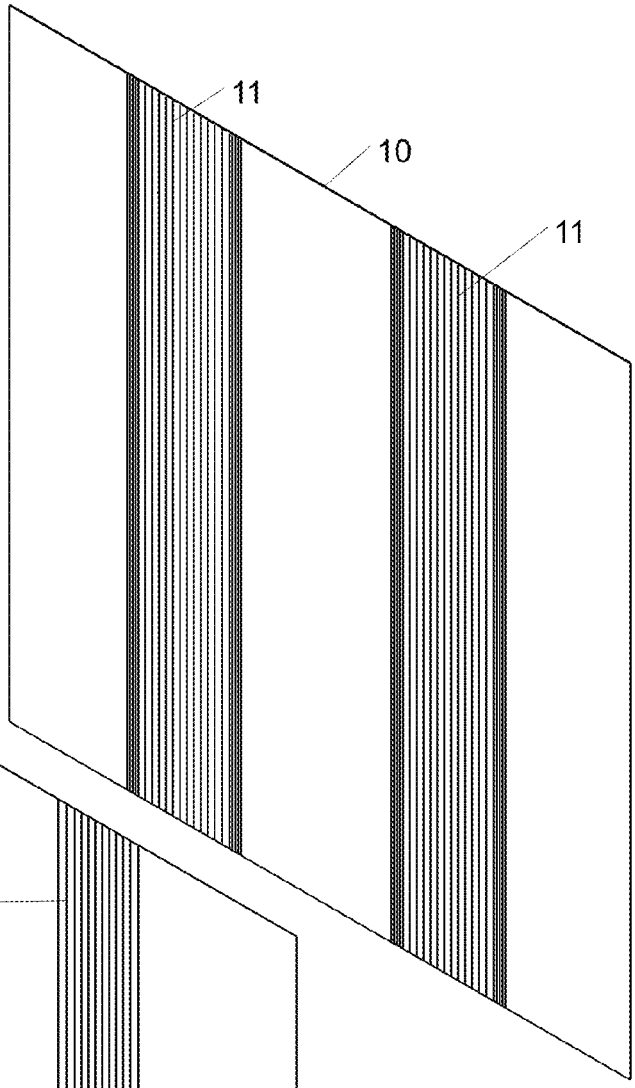
FIG. 17 shows a perspective view of an example embodiment of flat light modifying element with two groupings of linear refraction features.

An example embodiment may also comprise a flat sheet lens with no raised sections as shown in FIG. 17. LME 10 may comprise a flat sheet of optical material and may include linear refraction features 11. Example embodiments may comprise clear or translucent substrates as previously described with refraction feature configurations similar to those shown in FIG. 17, and configured on either surface as previously described. Example embodiments may also comprise flat optical film lenses as described in related PCT Patent Application PCT/US2013/039895 entitled "Frameless Light Modifying Element". An example embodiment of optical film lens may be shown in FIG. 19A. FIG. 19A may show a perspective view of the front-light emitting side of the LME 10, and may include a refraction features 11 similar to that shown in FIG. 17 or FIG. 18, wherein the linear refraction features may be configured on either surface of the optical film by methods previously described. Four edge trusses 16 may be configured from folds in the optical film, and disposed at an angle relative to the front side of the lens and disposed on the back side of the lens, wherein the edges trusses may support the lens in a substantially planar configuration when the example embodiment of optical film lens is attached to a light fixture. In FIG. 19, only two of the four edge trusses may be visible.

Figure 18:
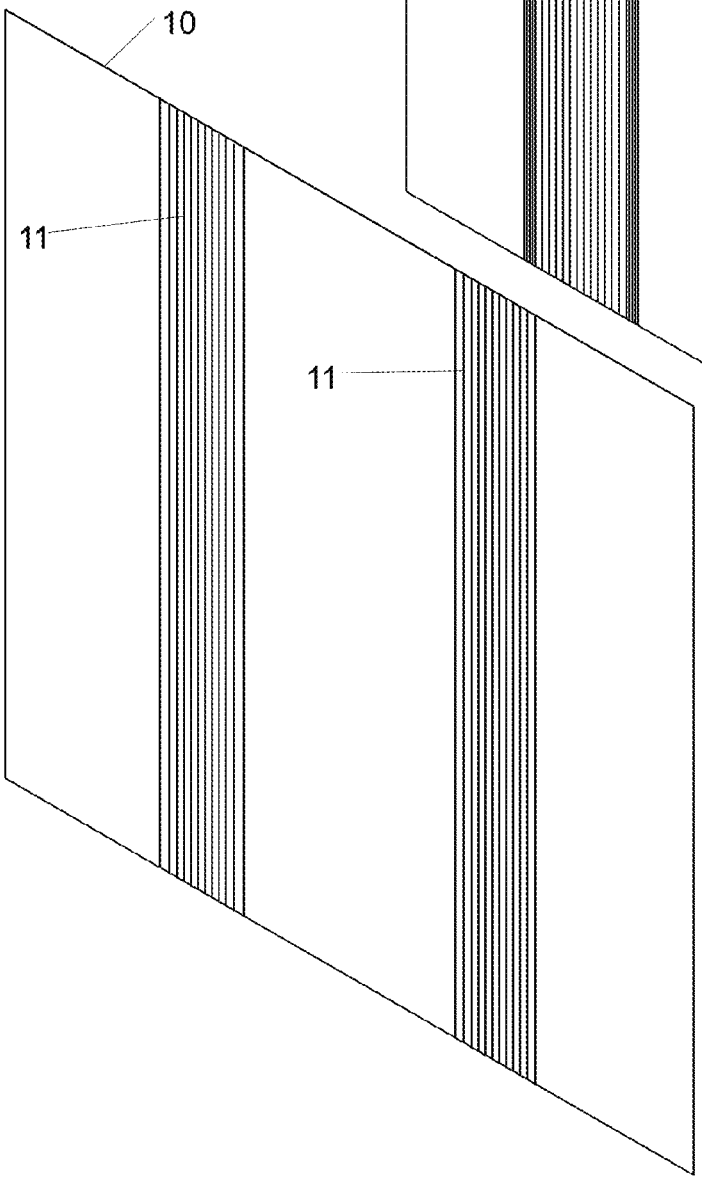
FIG. 18 shows a perspective view of another example embodiment of flat light modifying element with two groupings of linear refraction features.
Figure 19:
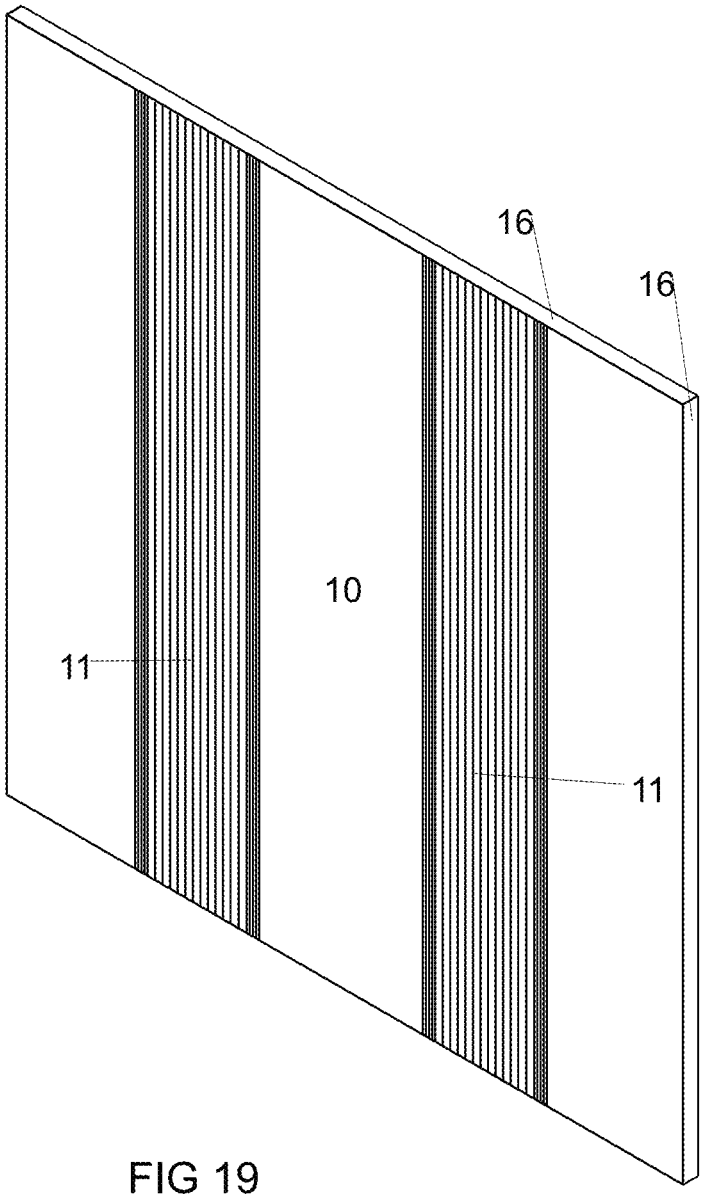
FIG. 19 shows a perspective view of an example embodiment of flat light modifying element comprising optical film, that includes two groupings of linear refraction features.

In an example embodiment as shown in FIG. 18, the LME 10 may comprise refraction elements 11 that may comprise two groupings of evenly spaced refraction features 11. This alternate arrangement of refraction features may be utilized on previously described example embodiments of LME.

Refraction features in any of the example embodiments herein described may be included to increase visual and aesthetic appeal as well as create increased lamp hiding as previously described. Accordingly, inclusion or omission of refraction features or elements, or the specific pattern of any refraction features or elements may be optional or may vary, and the scope of example embodiments should not be limited in any way if refraction features or elements are omitted or modified from those described.

Example implementations have been described that may include LED arrays. However, the scope of possible light sources that may be utilized with example embodiments of the disclosed technology should not be limited in any way, and may include any light source which may be practical which includes, but is not limited to, alternate LED array configurations.

In an example embodiment, a light fixture may comprise an enclosure with four or more sides, an enclosure back surface defining a back surface plane of the enclosure, a center axis that is equidistant and parallel to two of the four or more sides, and an aperture plane defined by outermost edges of the four or more sides. Two or more linear light emitting diode (LED) arrays may be configured to mount within the enclosure, wherein each linear LED array may comprise one or more linear LED strips comprising one or more rows of LEDs. Each LED array may comprise a front light emitting side, and a backside opposite of the front light emitting side. In an example implementation, one or more LED array mounting features may be configured to dissipate heat generated from linear LED arrays, wherein each LED array mounting feature may comprising at least two front elongated planar surfaces configured for attaching to two or more linear LED arrays. In an example embodiment, the one or more LED array mounting features may be disposed parallel and in proximity to the center axis of the enclosure back surface, and each of the at least two front elongated planar surfaces of the one or more linear LED array mounting features may face two opposite sides of the enclosure, and may be oriented at an angle between about 80 degrees and about 135 degrees relative to the back surface plane of the enclosure.

In an example embodiment, each LED array mounting feature may comprise an integral curved light reflecting panel that may include a thermally conductive material with a reflecting surface configured to reflect light. The elongated planar surface may comprises a flange formed along one edge of the reflector panel configured to mount at least one linear LED array.

In an example embodiment, an LED array mounting feature may comprise an integral flat, flexible light reflecting panel that may include a thermally conductive material defining a reflecting surface configured to reflect light. The flexible flat light reflecting panel may form a curved reflecting surface when laterally compressed and installed in a light fixture enclosure. Each LED array mounting feature may comprise an elongated planar surface comprising a flange formed along one edge of the reflector panel configured to mount at least one linear LED array.

In an example embodiment, an LED array mounting feature may comprise a thermally conductive extrusion that includes at least two elongated planar coaxial ribs, wherein an angle between the elongated planar coaxial ribs is between about 80 and about 135 degrees. A first one of the at least two elongated planar coaxial ribs may be configured to mount to an enclosure back surface, and wherein at least one linear LED array may be configured to mount to a second one of the at least two elongated planar coaxial ribs.

In an example embodiment, an LED array mounting feature may comprise a single metal extrusion that includes at least two side ribs and a bottom rib, wherein the at least two side ribs comprise a front elongated planar surface that forms an angle of between about 80 degrees and about 135 degrees with respect to the bottom rib. The bottom rib may be configured to mount on the back surface of an enclosure, and wherein at least one linear LED array may be configured to mount on the front elongated planar surface of each of the at least two side ribs.

In an example embodiment, a lens may comprise a clear or translucent substrate. The clear or translucent substrate may comprise any polymer, glass or optical film, and may be configured to modify light from linear LED arrays. The lens may further comprise two lens halves defining opposing, substantially planar outer portions and curved inner portions; the planar outer portions including outer edges that may be disposed in proximity to opposing edges of an aperture plane of an enclosure, and the outer edges of the two lens halves may be substantially parallel to one other. An axis of symmetry may define the two lens halves, wherein the two lens halves may be substantially similar to one another, and wherein the two lens halves may be configured to intersect or join in proximity to the axis of symmetry. The axis of symmetry may disposed above, or in proximity to one or more LED array mounting features.

In an example embodiment, a lens may comprise one or more pieces of optical film and may be configured to modify light from linear LED arrays. The lens may further comprise two lens halves defining opposing, substantially planar outer portions and curved inner portions; the planar outer portions including outer edges that may be disposed in proximity to opposing edges of an aperture plane of an enclosure, and the outer edges of the two lens halves may be substantially parallel to one other. An axis of symmetry may define the two lens halves, wherein the two lens halves may be substantially similar to one another, and wherein the two lens halves may be configured to intersect or join in proximity to the axis of symmetry. The axis of symmetry may disposed above, or in proximity to one or more LED array mounting features. The one or more pieces of optical film may comprise one or more edge trusses, wherein each of the one or more edge trusses may include one or more sides configured from a corresponding fold in the one or more pieces of optical film. At least one of the one or more sides of the one or more edge trusses may be configured at an angle relative to a front light-emitting side of the lens to impart support to the lens and to resist deflection of each edge truss.

In an example embodiment, a lens may comprise a clear or translucent substrate. The clear or translucent substrate may comprise any polymer, glass or optical film, and may be configured to modify light from linear LED arrays. The lens may further comprise two lens halves defining opposing, substantially planar outer portions and curved inner portions; the planar outer portions including outer edges that may be disposed in proximity to opposing edges of an aperture plane of an enclosure, and the outer edges of the two lens halves may be substantially parallel to one other. An axis of symmetry may define the two lens halves, wherein the two lens halves may be substantially similar to one another, and wherein the two lens halves may be configured to intersect or join in proximity to the axis of symmetry. The axis of symmetry may disposed above, or in proximity to one or more LED array mounting features. The lens may further define a plane of incidence and a first surface, and at least one refraction feature pattern or shape region defining a feature pattern or shape region comprising at least one refraction element. The at least one refraction element may comprise, as applicable, one or more of:

a height variation of the first surface;
a thickness variation of the substrate;
a refractive index variation of the first surface;
a refractive index variation of the substrate;
a coating in contact with the first surface.

The at least one refraction element of the at least one refraction feature pattern or shape region may be configured to alter a transmittance angle of at least a portion of light input to the lens at an incidence angle with respect to the plane of incidence.

In an example embodiment, a lens may comprise a clear or translucent substrate. The clear or translucent substrate may comprise any polymer, glass or optical film, and may be configured to modify light from linear LED arrays. The lens may further comprise two lens halves defining opposing, substantially curved portions, including outer edges that may be disposed in proximity to opposing edges of an aperture plane of an enclosure, and the outer edges of the two lens halves may be substantially parallel to one other. An axis of symmetry may define the two lens halves, wherein the two lens halves may be substantially similar to one another, and wherein the two lens halves may be configured to intersect or join in proximity to the axis of symmetry. The axis of symmetry may disposed above, or in proximity to one or more LED array mounting features.

In an example embodiment, a lens may comprise one or more pieces of optical film and may be configured to modify light from linear LED arrays. The lens may further comprise two lens halves defining opposing, substantially curved inner portions, including outer edges that may be disposed in proximity to opposing edges of an aperture plane of an enclosure, and the outer edges of the two lens halves may be substantially parallel to one other. An axis of symmetry may define the two lens halves, wherein the two lens halves may be substantially similar to one another, and wherein the two lens halves may be configured to intersect or join in proximity to the axis of symmetry. The axis of symmetry may disposed above, or in proximity to one or more LED array mounting features. The one or more pieces of optical film may comprise one or more edge trusses, wherein each of the one or more edge trusses may include one or more sides configured from a corresponding fold in the one or more pieces of optical film. At least one of the one or more sides of the one or more edge trusses may be configured at an angle relative to a front light-emitting side of the lens to impart support to the lens and to resist deflection of each edge truss.

In an example embodiment, a lens may comprise a clear or translucent substrate. The clear or translucent substrate may comprise any polymer, glass or optical film, and may be configured to modify light from linear LED arrays. The lens may further comprise two opposing outer lens edges that are substantially parallel to each other, wherein each outer lens edge may be disposed in proximity to opposing edges of the aperture plane of an enclosure. A V-shaped bi-planar center lens section may be disposed over one or more LED array mounting features, and may comprise a peak axis and two base axes, wherein the peak axis may be disposed closer to the aperture plane than the two base axes. A substantially planar middle lens section may be disposed on each side of the V-shaped bi-planar center lens section, wherein each substantially planar middle lens section may include one inner axis that is coaxial with a corresponding base axis of the center lens section and one outer axis that is closer to the aperture plane than the inner axis. The lens may also include two substantially planar outer sections, wherein each substantially planar outer section may include an outer edge that includes one of the two opposing lens edges, and an inner axis that is coaxial with the outer axis of the middle lens section.

In an example embodiment, a lens may be configured to modify light from linear LED arrays. The lens may comprise one or more pieces of optical film having a front light-emitting side and a back light-receiving side, and a V-shaped bi-planar center lens section that may be disposed over one or more LED array mounting features. The V-shaped bi-planar center lens section may comprise a peak axis and two base axes, wherein the peak axis may be disposed closer to an aperture plane of a light fixture than the two base axes, and wherein each axis may be configured from a fold in the one or more pieces of optical film. The lens may further comprise a substantially planar middle lens section on each side of the V-shaped bi-planar center lens section, wherein each substantially planar middle lens section may have one inner axis that is coaxial with a corresponding base axis of the center lens section, and one outer axis that may be closer to the aperture plane than the inner axis, and wherein each axis may be configured from a fold in the one or more pieces of optical film. The lens may further comprise two substantially planar outer sections, wherein each substantially planar outer section may include an outer edge that includes one of the two opposing lens edges, and an inner axis that may be coaxial with the outer axis of the middle lens section. The one or more pieces of optical film may comprise one or more edge trusses, wherein each of the one or more edge trusses may include one or more sides configured from a corresponding fold in the one or more optical films, wherein at least one of the one or more sides of the one or more edge trusses may be configured at an angle relative to the front light-emitting side of the one or more optical film pieces to impart support to the lens and to resist deflection of each edge truss.

In an example embodiment, a lens may be configured to modify light from linear LED arrays, the lens comprising a clear or translucent substrate comprising or one or more pieces of optical film, the lens defining a plane of incidence and having a first surface. The substrate or optical film may comprise two opposing outer lens edges that may be substantially parallel to each other, wherein each outer lens edge may be disposed in proximity to opposing edges of a light fixture aperture plane. The lens may further comprise a V-shaped bi-planar center lens section that may be disposed over one or more LED array mounting features, and may comprise a peak axis and two base axes, wherein the peak axis may be disposed closer to the aperture plane than the two base axes. A substantially planar middle lens section may be disposed on each side of the V-shaped bi-planar center lens section, wherein each substantially planar middle lens section may include one inner axis that is coaxial with a corresponding base axis of the center lens section and one outer axis that is closer to the aperture plane than the inner axis. The lens may also include two substantially planar outer sections, wherein each substantially planar outer section may include an outer edge that includes one of the two opposing lens edges, and an inner axis that is coaxial with the outer axis of the middle lens section. The lens may further comprise at least one refraction feature pattern or shape region defining a feature pattern or shape region comprising at least one refraction element The at least one refraction element may comprise, as applicable, one or more of:

a height variation of the first surface;
a thickness variation of the substrate;
a refractive index variation of the first surface;
a refractive index variation of the substrate;
a coating in contact with the first surface.

At least one refraction element of the at least one refraction feature pattern or shape region may be configured to alter a transmittance angle of at least a portion of light input to the lens at an incidence angle with respect to the plane of incidence.

In an example first implementation, a lens may be configured to modify incident light, and may comprise a top edge, a bottom edge, a left edge and a right edge collectively defining a lens plane, and may further comprise two raised lens sections. Each raised lens section may comprise an elongated rectangular shape that substantially spans between the top and bottom lens edges and may be substantially parallel to the left and right lens edges. The raised lens sections may include a substantially planar face with a light-receiving side and a light-emitting side wherein the substantially planar face may define a raised lens section plane that is elevated at a distance above the lens plane. The raised lens sections may also include two opposing edges disposed at acute angles relative to the light receiving side of the substantially planar face, wherein each edge may form an overlay attachment feature. The lens may further comprise three substantially planar sections comprising a middle planar section disposed between the two raised sections and two outer planar sections disposed on either side of the raised lens sections.

In an example embodiment, the first example implementation may include one or more optical film overlays disposed in a substantially planar configuration over the light receiving side of each raised section. The optical film overlays may comprise a strip of optical film configured to modify light; the strip of optical film comprising two opposing edges, wherein the two opposing edges nest in two opposing overlay mounting features.

In an example embodiment, the first example implementation may include one or more optical film overlays configured to modify light, wherein the one or more optical film overlays may be disposed over the light receiving side of each raised lens section. The optical film overlays may comprise a strip of optical film comprising two opposing edges and a width that is greater than a width of each raised lens section, wherein the optical film strip may configured into a curved shape by the lateral compression of two opposing edges of the optical film strip, and retained in that compressed curved state by nesting in two opposing overlay mounting features.

In an example embodiment, the first example implementation may further comprise one or more pieces of optical film configured to modify light. The one or more pieces of optical film may comprise one or more edge trusses, wherein each of the one or more edge trusses may include one or more sides configured from a corresponding fold in the one or more optical films. At least one of the one or more sides of the one or more edge trusses may be configured at an angle relative to the lens plane to impart support to the lens and to resist deflection of each edge truss. The raised lens sections and the overlay mounting features may be created by folds in the one or more pieces of optical film.

In an example embodiment, the first example implementation, the substantially planar face of each raised section may be further defined by a plane of incidence and having a first surface comprising a uniform transmittance region. Either side of the substantially planar face may be configured with three groupings of parallel and adjacent elongated linear refraction elements comprising a center grouping of elongated linear refraction elements and two outer groupings of elongated linear refraction elements. The spacing between the linear refraction elements in the two outer groupings may be smaller than the spacing between the linear refraction elements in the center grouping, and wherein each elongated linear refraction element may comprise, as applicable, one or more of:

a height variation of the first surface;
a thickness variation of the substrate;
a refractive index variation of the first surface;
a refractive index variation of the substrate;
a coating in contact with the first surface.

The elongated linear refraction elements may be configured to alter a transmittance angle of at least a portion of light input to the lens at an incidence angle with respect to the plane of incidence.

In an example embodiment, the first example implementation, the substantially planar face of each raised section may further be defined by a plane of incidence and having a first surface comprising a uniform transmittance region. Either side of the substantially planar face may be configured with a single grouping of parallel and adjacent elongated linear refraction elements wherein each elongated linear refraction element comprises, as applicable, one or more of:

a height variation of the first surface;
a thickness variation of the substrate;
a refractive index variation of the first surface;
a refractive index variation of the substrate;
a coating in contact with the first surface.

The elongated linear refraction elements may be configured to alter a transmittance angle of at least a portion of light input to the lens at an incidence angle with respect to the plane of incidence.

In an example embodiment, a lens may comprise a substrate defining a plane of incidence and having a first surface The substrate may comprise a uniform transmittance region and at least one refraction feature pattern or shape region adjacent to the uniform transmittance region and defining a feature pattern or shape region that may comprise at least one refraction element. The at least one refraction element may comprise, as applicable, one or more of:

a height variation of the first surface;
a thickness variation of the substrate;
a refractive index variation of the first surface;
a refractive index variation of the substrate;
a coating in contact with the first surface.

At least one refraction element of the at least one refraction feature pattern or shape region may be configured to alter a transmittance angle of at least a portion of light input to the lens at an incidence angle with respect to the plane of incidence.

In an example second implementation, a lens may comprise a substrate defining a plane of incidence and having a first surface. The substrate may comprise a uniform transmittance region, at least one refraction feature pattern or shape region adjacent to the uniform transmittance region and defining a feature pattern or shape region comprising at least one refraction element. The at least one refraction element may comprise, as applicable, one or more of:

a height variation of the first surface;
a thickness variation of the substrate;
a refractive index variation of the first surface;
a refractive index variation of the substrate;
a coating in contact with the first surface.

The at least one refraction element of the at least one refraction feature pattern or shape region may be configured to alter a transmittance angle of at least a portion of light input to the lens at an incidence angle with respect to the plane of incidence.

In an example embodiment of the second implementation, the at least one refraction element may comprise one or more of: an elongated linear groove, an elongated linear protuberance, and elongated linear regions comprising a coating.

In an example embodiment of the second implementation, the at least one refraction element may comprise a printed surface coating.

In an example embodiment of the second implementation, the at least one refraction element may comprise at least one refraction element comprising a refraction gradient.

In an example embodiment of the second implementation, the at least one refraction element may comprise surface variations created by a laser-based device.

In an example embodiment of the second implementation, the lens may be fabricated by an injection molding process utilizing one or more mold cavities, wherein the one or more refraction elements may comprise surface variation in the lens first surface that are created by textures or patterns in corresponding areas of the one or more mold cavities.

While certain implementations of the disclosed technology have been described in connection with what is presently considered to be the most practical and various implementations, it is to be understood that the disclosed technology is not to be limited to the disclosed implementations, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain implementations of the disclosed technology, including the best mode, and also to enable any person skilled in the art to practice certain implementations of the disclosed technology, including making and using any devices or systems and performing any incorporated methods. The patentable scope of certain implementations of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A light fixture comprising:

an enclosure comprising:

four or more sides;

an enclosure back surface defining a back surface plane of the enclosure;

a center axis that is equidistant and parallel to two of the four or more sides;

an aperture plane defined by outermost edges of the four or more sides;

two or more linear light emitting diode (LED) arrays configured to mount within the enclosure, each linear LED array comprising:

one or more linear LED strips comprising one or more rows of LEDs mounted on at least one circuit board;

a front light emitting side; and a back side opposite of the front light emitting side;

one or more LED array mounting features configured to dissipate heat generated from the two or more linear LED arrays, each LED array mounting feature comprising:

one or more elongated thermally conductive mounting features configured for attachment to the enclosure, the one or more thermally conductive mounting features comprising at least two front elongated planar surfaces configured for attaching to the two or more linear LED arrays; and wherein the one or more LED array mounting features are disposed parallel and in proximity to the center axis of the enclosure back surface, and each of the at least two front elongated planar surfaces of the one or more linear LED array mounting features faces two opposite sides of the enclosure and are oriented at an angle between about 80 degrees and about 135 degrees relative to the back surface plane of the enclosure.

2. The light fixture of claim 1, wherein each of the one or more LED array mounting features comprise an integral curved light reflecting panel that includes a thermally conductive material with a reflecting surface configured to reflect light, and wherein the elongated planar surface comprises a flange formed along one edge of the reflector panel configured to mount at least one linear LED array.

3. The light fixture of claim 1, wherein each of the one or more LED array mounting features comprise an integral, flexible light reflecting panel that includes a thermally conductive material defining a reflecting surface configured to reflect light, wherein the flexible light reflecting panel forms a curved reflecting surface when laterally compressed and installed in the light fixture enclosure, and wherein the elongated planar surface of the one or more LED array mounting features comprises a flange formed along one edge of the reflector panel configured to mount at least one linear LED array.

4. The light fixture of claim 1, wherein the one or more LED array mounting features comprise two or more thermally conductive mounting features, wherein each LED array mounting feature includes at least two elongated planar coaxial ribs, wherein an angle between the elongated planar coaxial ribs is between about 80 and about 135 degrees, and wherein a first one of the at least two elongated planar coaxial ribs is configured to mount to the enclosure back surface, and wherein at least one of the two or more linear LED arrays is configured to mount to a second one of the at least two elongated planar coaxial ribs.

5. The light fixture of claim 1,wherein the one or more LED array mounting features comprise a single thermally conductive mounting feature that includes at least two side ribs and a bottom rib, wherein the at least two side ribs comprise a front elongated planar surface that forms an angle of between about 80 degrees and about 135 degrees with respect to the bottom rib, and wherein the bottom rib is configured to mount on the back surface of the enclosure, and wherein at least one of the two or more linear LED arrays is configured to mount on the front elongated planar surface of each of the at least two side ribs.

6. The light fixture of claim 1, further comprising:

a lens configured to modify light from the two or more linear LED arrays, the lens further comprising:

two lens halves defining opposing, substantially planar outer portions and curved inner portions, the planar outer portions including outer edges disposed in proximity to opposing edges of the aperture plane of the enclosure, the outer edges of the two lens halves substantially parallel to one other; and an axis of symmetry defining the two lens halves, wherein the two lens halves are substantially similar to one another, and wherein the two lens halves are configured to intersect or join in proximity to the axis of symmetry, wherein the axis of symmetry is disposed above, or in proximity to the one or more LED array mounting features.

7. The light fixture of claim 6, wherein the lens comprises one or more pieces of optical film, and the lens further comprises:

one or more edge trusses, wherein each of the one or more edge trusses includes one or more sides configured from a corresponding fold in the one or more pieces of optical film, wherein at least one of the one or more sides of the one or more edge trusses is configured at an angle relative to a front light-emitting side of the lens to impart support to the lens and to resist deflection of each edge truss.

8. The light fixture of claim 6, wherein the lens defines a plane of incidence and a first surface, and wherein the lens further comprises at least one refraction feature pattern or shape region defining a feature pattern or shape region comprising at least one refraction element, the at least one refraction element comprising one or more of:

a height variation of the first surface;

a thickness variation of the substrate;

a refractive index variation of the first surface;

a refractive index variation of the substrate;

a coating in contact with the first surface; and wherein the at least one refraction element of the at least one refraction feature pattern or shape region is configured to alter a transmittance angle of at least a portion of light input to the lens at an incidence angle with respect to the plane of incidence.

9. The light fixture of claim 1, further comprising:

a lens configured to modify light from the two or more linear LED arrays, the lens further comprising:

two lens halves defining opposing, substantially curved portions having outer edges disposed in proximity to opposing edges of the aperture plane of the enclosure, the outer edges of the two lens halves substantially parallel to one other; and an axis of symmetry defining the two lens halves, wherein the two lens halves are substantially similar to one another, and wherein the two lens halves are configured to intersect or join in proximity to the axis of symmetry, wherein the axis of symmetry is disposed above, or in proximity to the one or more LED array mounting features.

10. The light fixture of claim 9, wherein the lens comprises one or more pieces of optical film, and the lens further comprises:

one or more edge trusses, wherein each of the one or more edge trusses includes one or more sides configured from a corresponding fold in the one or more pieces of optical film, wherein at least one of the one or more sides of the one or more edge trusses is configured at an angle relative to a front light-emitting side of the lens to impart support to the lens and to resist deflection of each edge truss.

11. The light fixture of claim 1, further comprising:

a lens configured to modify light from the two or more linear LED arrays, the lens further comprising:

two opposing outer lens edges that are substantially parallel to each other, wherein each outer lens edge is disposed in proximity to opposing edges of the aperture plane of the enclosure;

a V-shaped bi-planar center lens section disposed over the one or more LED array mounting features, the V-shaped bi-planar center lens section comprising:

a peak axis and two base axes, wherein the peak axis is disposed closer to the aperture plane than the two base axes;

substantially planar middle lens sections on each side of the V-shaped bi-planar center lens section, wherein each substantially planar middle lens section includes one inner axis that is coaxial with a corresponding base axis of the center lens section and one outer axis that is closer to the aperture plane than the inner axis; and two substantially planar outer sections, wherein each substantially planar outer section includes an outer edge that includes one of the two opposing lens edges, and an inner axis that is coaxial with the outer axis of the middle lens section.

12. The light fixture of claim 1, further comprising:

a lens configured to modify light from the two linear LED arrays, the lens comprising:

one or more pieces of optical film having a front light-emitting side and a back light-receiving side;

a V-shaped bi-planar center lens section disposed over the one or more LED array mounting features, the V-shaped bi-planar center lens section comprising a peak axis and two base axes, wherein the peak axis is disposed closer to the aperture plane than the two base axes, and wherein each axis is configured from a fold in the one or more pieces of optical film;

a substantially planar middle lens section on each side of the V-shaped bi-planar center lens section, wherein each substantially planar middle lens section has one inner axis that is coaxial with a corresponding base axis of the center lens section, and one outer axis that is closer to the aperture plane than the inner axis, and wherein each axis is configured from a fold in the one or more pieces of optical film;

two substantially planar outer sections, wherein each substantially planar outer section includes an outer edge that includes one of the two opposing lens edges, and an inner axis that is coaxial with the outer axis of the middle lens section; and wherein the one or more pieces of optical film comprise one or more edge trusses, wherein each of the one or more edge trusses include one or more sides configured from a corresponding fold in the one or more optical films, wherein at least one of the one or more sides of the one or more edge trusses is configured at an angle relative to the front light-emitting side of the one or more optical film pieces to impart support to the lens and to resist deflection of each edge truss.

13. The light fixture of claim 1, further comprising:

a lens configured to modify light from the two linear LED arrays, the lens comprising:

a clear or translucent substrate comprising or one or more pieces of optical film, the lens defining a plane of incidence and having a first surface, the substrate or optical film comprising:

two opposing outer lens edges that are substantially parallel to each other, wherein each outer lens edge is disposed in proximity to opposing edges of the aperture plane;

a V-shaped bi-planar center lens section disposed over the one or more LED array mounting features, the V-shaped bi-planar center lens section comprising a peak axis and two base axes, wherein the peak axis is disposed closer to the aperture plane than the two base axes;

a substantially planar middle lens section on each side of the V-shaped bi-planar center lens section, wherein each substantially planar middle lens section has one inner axis that is coaxial with a corresponding base axis of the center lens section, and one outer axis that is closer to the aperture plane than the inner edge;

two substantially planar outer sections, wherein each substantially planar outer section includes an outer edge that includes one of the two opposing lens edges, and an inner axis that is coaxial with the outer axis of the middle lens section;

and wherein the lens further comprises at least one refraction feature pattern or shape region defining a feature pattern or shape region comprising at least one refraction element, the at least one refraction element comprising one or more of:

a height variation of the first surface;

a thickness variation of the substrate;

a refractive index variation of the first surface;

a refractive index variation of the substrate;

a coating in contact with the first surface; and wherein the at least one refraction element of the at least one refraction feature pattern or shape region is configured to alter a transmittance angle of at least a portion of light input to the lens at an incidence angle with respect to the plane of incidence.

14. A lens comprising:

a top edge, a bottom edge, a left edge and a right edge collectively defining a lens plane;

two raised lens sections, each raised lens section comprising:

an elongated rectangular shape that substantially spans between the top and bottom lens edges and that is substantially parallel to the left and right lens edges;

a substantially planar face with a light-receiving side and a light-emitting side wherein the substantially planar face defines a raised lens section plane that is elevated at a distance above the lens plane;

two opposing edges disposed at acute angles relative to the light receiving side of the substantially planar face, wherein each edge forms an overlay attachment feature;

the lens further comprising three substantially planar sections comprising a middle planar section disposed between the two raised sections and two outer planar sections disposed on either side of the raised lens sections; and wherein the lens is configured to modify incident light.

15. The lens of claim 14, further comprising one or more optical film overlays disposed in a substantially planar configuration over the light receiving side of each raised section, the optical film overlay comprising a strip of optical film configured to modify light, the strip of optical film comprising two opposing edges, wherein the two opposing edges nest in two opposing overlay mounting features.

16. The lens of claim 14, further comprising one or more optical film overlays configured to modify light, and wherein the one or more optical film overlays are disposed over the light receiving side of each raised lens section, the optical film overlay comprising a strip of optical film comprising two opposing edges and a width that is greater than a width of each raised lens section, wherein the optical film strip is configured into a curved shape by the lateral compression of two opposing edges of the optical film strip, and retained in that compressed curved state by nesting in two opposing overlay mounting features.

17. The lens of claim 14, further comprising one or more pieces of optical film configured to modify light, the one or more pieces of optical film comprising:

one or more edge trusses, wherein each of the one or more edge trusses include one or more sides configured from a corresponding fold in the one or more optical films, wherein at least one of the one or more sides of the one or more edge trusses is configured at an angle relative to the lens plane to impart support to the lens and to resist deflection of each edge truss, and wherein the raised lens sections and the overlay mounting features are created by folds in the one or more pieces of optical film.

18. The lens of claim 14, wherein either side of the substantially planar face of each raised section is further defined by a plane of incidence and having a first surface comprising a uniform transmittance region, and either side of the substantially planar face is configured with three groupings of parallel and adjacent elongated linear refraction elements comprising a center grouping of elongated linear refraction elements and two outer groupings of elongated linear refraction elements, wherein spacing between the linear refraction elements in the two outer groupings is smaller than the spacing between the linear refraction elements in the center grouping, and wherein each elongated linear refraction element comprises one or more of:

a height variation of the first surface;
a thickness variation of the substrate;
a refractive index variation of the first surface;
a refractive index variation of the substrate;
a coating in contact with the first surface; and
wherein the elongated linear refraction elements are configured to alter a transmittance angle of at least a portion of light input to the lens at an incidence angle with respect to the plane of incidence.

19. The lens of claim 14, wherein either side of the substantially planar face of each raised section is further defined by a plane of incidence and having a first surface comprising a uniform transmittance region and either side of the substantially planar face is configured with a single grouping of parallel and adjacent elongated linear refraction elements wherein each elongated linear refraction element comprises one or more of:

a height variation of the first surface;
a thickness variation of the substrate;
a refractive index variation of the first surface;
a refractive index variation of the substrate;
a coating in contact with the first surface; and
wherein the elongated linear refraction elements are configured to alter a transmittance angle of at least a portion of light input to the lens at an incidence angle with respect to the plane of incidence.

20. A lens for modifying light from a light emitting device, the lens comprising:

a substrate defining a plane of incidence and having a first surface, the substrate comprising:
four edges, a light emitting front side and a light receiving back side;
two groupings of parallel and adjacent elongated linear refraction elements spanning substantially between two opposing edges of the substrate, wherein each grouping is parallel to each other and wherein each grouping is parallel to two opposing edges of the substrate, and wherein each grouping is configured to be disposed above, and parallel to a linear light source in a light emitting device, and wherein each elongated linear refraction element comprises, one or more of:
a height variation of the first surface;
a thickness variation of the optical film;
a refractive index variation of the first surface;
a refractive index variation of the optical film;
a coating in contact with the first surface; and
wherein the elongated linear refraction elements are configured to alter a transmittance angle of at least a portion of light input to the light modifying element at an incidence angle with respect to the plane of incidence.

21. A lens comprising:

a substrate defining a plane of incidence and having a first surface, the substrate comprising:
a uniform transmittance region; and
at least one refraction feature pattern or shape region adjacent to the uniform transmittance region and defining a feature pattern or shape region comprising at least one refraction element, the at least one refraction element comprising one or more of:
a height variation of the first surface;
a thickness variation of the substrate;
a refractive index variation of the first surface;
a refractive index variation of the substrate;
a coating in contact with the first surface; and
wherein the at least one refraction element of the at least one refraction feature pattern or shape region is configured to alter a transmittance angle of at least a portion of light input to the lens at an incidence angle with respect to the plane of incidence.

22. The lens of claim 21, wherein the at least one refraction element comprises one or more of: an elongated linear groove, an elongated linear protuberance, and elongated linear regions comprising a coating.

23. The lens of claim 21, wherein the at least one refraction element comprises a printed surface coating.

24. The lens of claim 21, wherein the at least one refraction element comprises at least one refraction element comprising a refraction gradient.

25. The lens of claim 21, wherein the at least one refraction element comprises surface variations created by a laser-based device.

26. The lens of claim 21, wherein the lens is fabricated by an injection molding process utilizing one or more mold cavities, wherein the one or more refraction elements comprise surface variation in the lens first surface that are created by textures or patterns in corresponding areas of the one or more mold cavities.

* * * * *